US009149914B2

(12) United States Patent
Barber et al.

(10) Patent No.: US 9,149,914 B2
(45) Date of Patent: Oct. 6, 2015

(54) KNIFE BLOCK SYSTEMS

(71) Applicant: Elemental Tools, LLC, Gainesville, VA (US)

(72) Inventors: Launce R. Barber, Richmond, VA (US); Simon Johnson, Christchurch (NZ)

(73) Assignee: Elemental Tools, LLC, Gainesville, VA (US)

( * ) Notice: Subject to any disclaimer, the term of this patent is extended or adjusted under 35 U.S.C. 154(b) by 259 days.

(21) Appl. No.: 13/891,450

(22) Filed: May 10, 2013

(65) Prior Publication Data

US 2013/0306500 A1 Nov. 21, 2013

Related U.S. Application Data

(60) Provisional application No. 61/645,234, filed on May 10, 2012.

(51) Int. Cl.
*A47F 7/00* (2006.01)
*B24D 15/08* (2006.01)

(52) U.S. Cl.
CPC ..... *B24D 15/084* (2013.01)

(58) Field of Classification Search
CPC ..... B24D 15/084; A47J 47/005; B26D 1/30; Y10T 83/8763
USPC ..... 211/70.7
See application file for complete search history.

(56) References Cited

U.S. PATENT DOCUMENTS

| | | | | |
|---|---|---|---|---|
| 4,561,548 | A * | 12/1985 | Call | 211/70.7 |
| 6,666,343 | B1 * | 12/2003 | Liu | 211/70.7 |
| 7,637,803 | B2 * | 12/2009 | Welch | 451/552 |
| 2005/0205506 | A1 * | 9/2005 | Siegel | 211/70.7 |
| 2005/0241984 | A1 * | 11/2005 | Mosko | 206/553 |

* cited by examiner

*Primary Examiner* — Korie H Chan
(74) *Attorney, Agent, or Firm* — Brian J. Teague

(57) ABSTRACT

A knife block system is described which in one embodiment includes a block unit having a magnetic core, a plurality of knives secured to the magnetic core of the block unit, a foot supporting the block unit, and at least one chopping board protruding from a surface of the block unit and removable from the block unit for use, the chopping board configured to fit into a chopping board back support attached to the block unit for storage when not in use, the chopping board having a female module formed therein. The system includes a knife sharpener unit removably attachable to the foot for use, the knife sharpener unit having a product logo on a surface thereof that is sized to mate with the female module on the chopping board to secure the knife sharpener unit to the chopping board as both items are in use.

11 Claims, 34 Drawing Sheets

KNIFE BLOCK SYSTEMS

CROSS-REFERENCE TO RELATED APPLICATION

The present application claims the benefit under 35 U.S.C. §119(e) of U.S. Provisional Patent Application No. 61/645,234 to Barber, et al., filed May 10, 2012, the entire contents of which is hereby incorporated by reference herein.

BACKGROUND

1. Field

Example embodiments in general relate to knife block systems having removable accessories attached thereto.

2. Related Art

Kitchen utensils such as knives, forks, and spoons typically are stored in a drawer underneath a countertop. Knives however have also been stored in a dedicated block, typically made entirely of wood. Such a storage unit has typically been referred to as a "knife block" or "block"; these are terms that are descriptive both of the overall shape of the structure and that the structure is a solid, compact piece of substantial material. Openings shaped in the form of slots are formed that typically run vertically down from a top surface and into the block, where the knives are inserted blade first.

More recently, the market offers a knife block that contains multiple sections that appear to be attached to form a unit, where each section has slotted openings to receive knives, a handled sharpener blade and/or a pair of scissors/shears. Additionally, certain ones of the sections include text labels such as "slicer", "bread", "utility", and "paring" that appear to refer to the function of the particular knife.

SUMMARY

An example embodiment is directed to a knife block system. The system includes a block unit having a plurality of slots on one surface thereof, a plurality of knives positioned within the slots, a foot supporting the block unit, and a glass cover overlay positioned on the block unit, the cover including indicia labeling the knives and providing a clear display of the knives there behind. The system includes at least one chopping board protruding from a surface of the block unit and removable from the block unit for use, the at least one chopping board configured to fit into a chopping board back support positioned opposite the knives on a surface of the block unit for storage when not in use, the at least one chopping board having a female module formed therein, and a knife sharpener unit removably attachable to the foot for use, the knife sharpener unit having a male connector on a surface thereof that mates with the female module on the at least one chopping board to secure the knife sharpener unit to the at least one chopping board as both items are in use.

Another example embodiment is directed to a knife block system which includes a block unit having a magnetic core, a plurality of knives secured to the magnetic core of the block unit, a foot supporting the block unit, and at least one chopping board protruding from a surface of the block unit and removable from the block unit for use, the at least one chopping board configured to fit into a chopping board back support positioned opposite the knives on a surface of the block unit for storage when not in use, the at least one chopping board having a female module formed therein. The system includes a knife sharpener unit removably attachable to the foot for use, the knife sharpener unit having a product logo on a surface thereof that is sized to mate with the female module on the at least one chopping board to secure the knife sharpener unit to the at least one chopping board as both items are in use.

Another example embodiment is directed to a knife block system which includes a block unit having a magnetic core, a plurality of knives secured to the magnetic core of the block unit, a foot supporting the block unit, and at least one chopping board protruding from a surface of the block unit and removable from the block unit for use, the at least one chopping board configured to fit into a chopping board back support positioned opposite the knives on a surface of the block unit for storage when not in use, the at least one chopping board having a female module formed therein. The system includes a removable clock/timer provided on the block unit, and a digital scale removably attachable to the foot for use, the digital scale having a product logo on a surface thereof that is sized to mate with the female module on the at least one chopping board to secure the digital scale to the at least one chopping board as both items are in use.

BRIEF DESCRIPTION OF THE DRAWINGS

Example embodiments will become more fully understood from the detailed description given herein below and the accompanying drawing, wherein like elements are represented by like reference numerals, which are given by way of illustration only and thus are not limitative of the example embodiments herein.

DETAILED DESCRIPTION

As to be set forth more fully below, the example embodiments in general are directed to a knife block system having removable accessories attached thereto.

Figure 1:
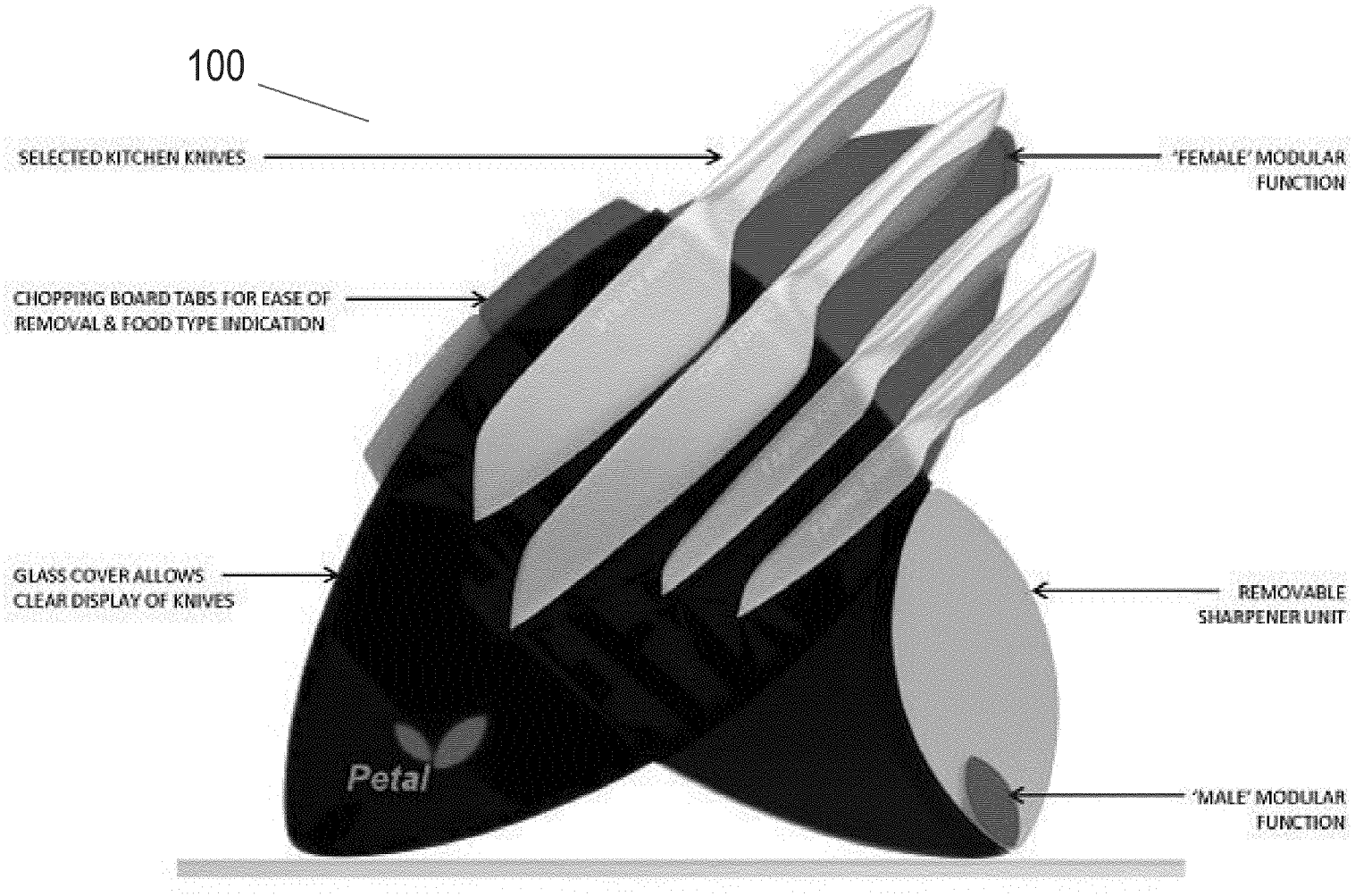
FIG. 1 is a front elevational view of a knife block system according to an example embodiment.
Figure 2:
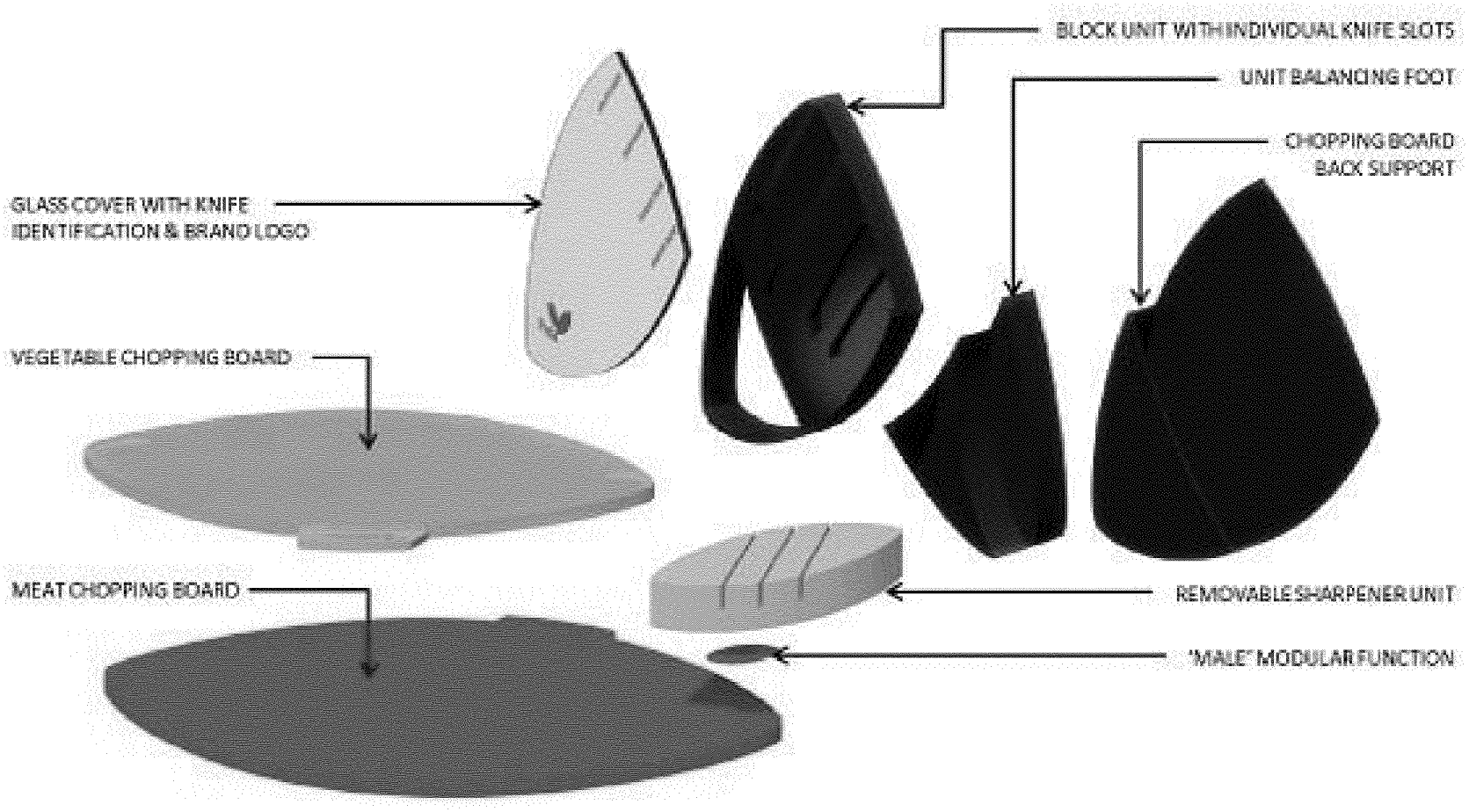
FIG. 2 is an exploded parts view of the system of FIG. 1.
Figure 3:
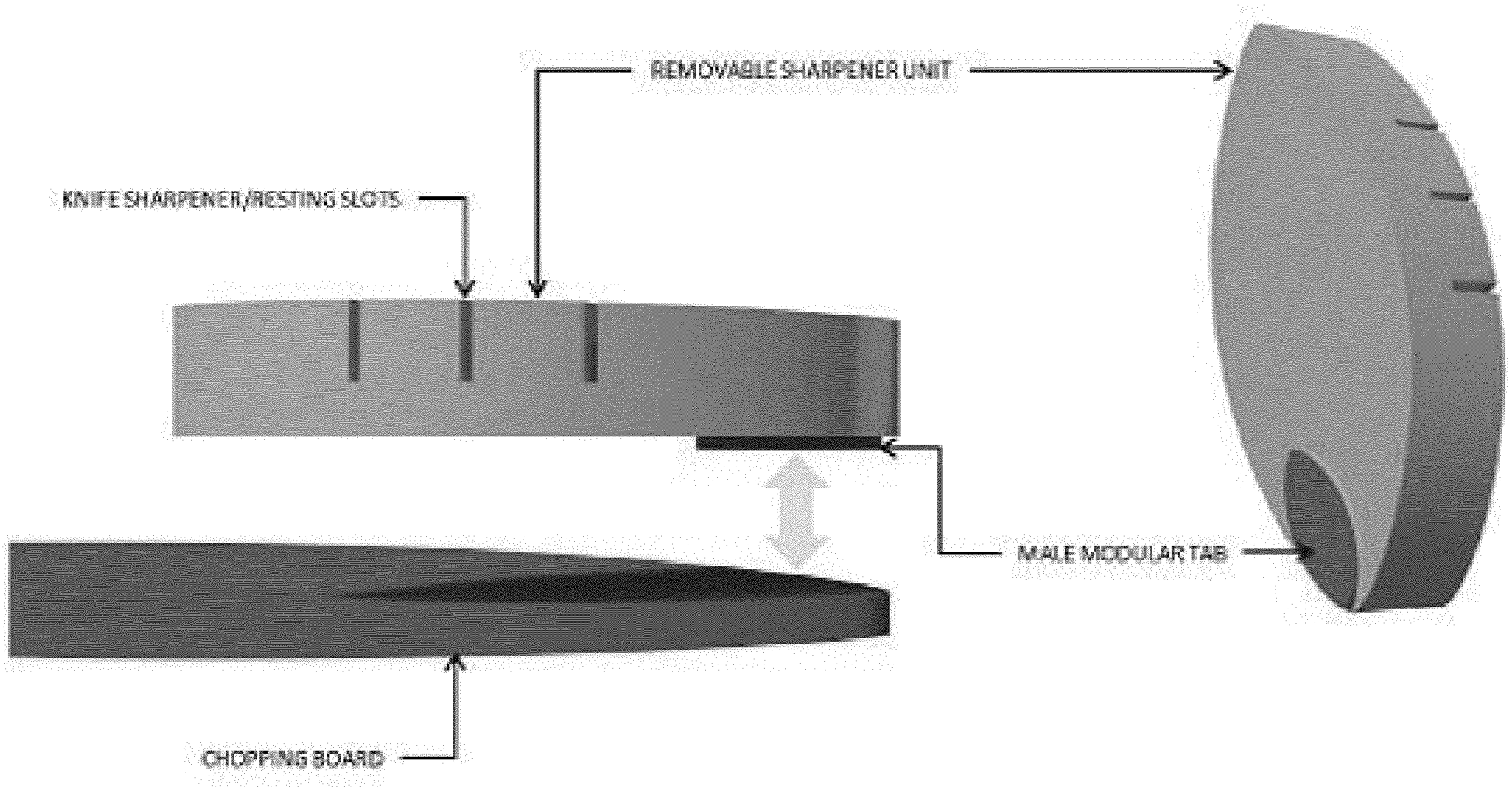
FIG. 3 is view of the sharpener unit and a chopping board to illustrate the interface there between in more detail.
Figure 4:
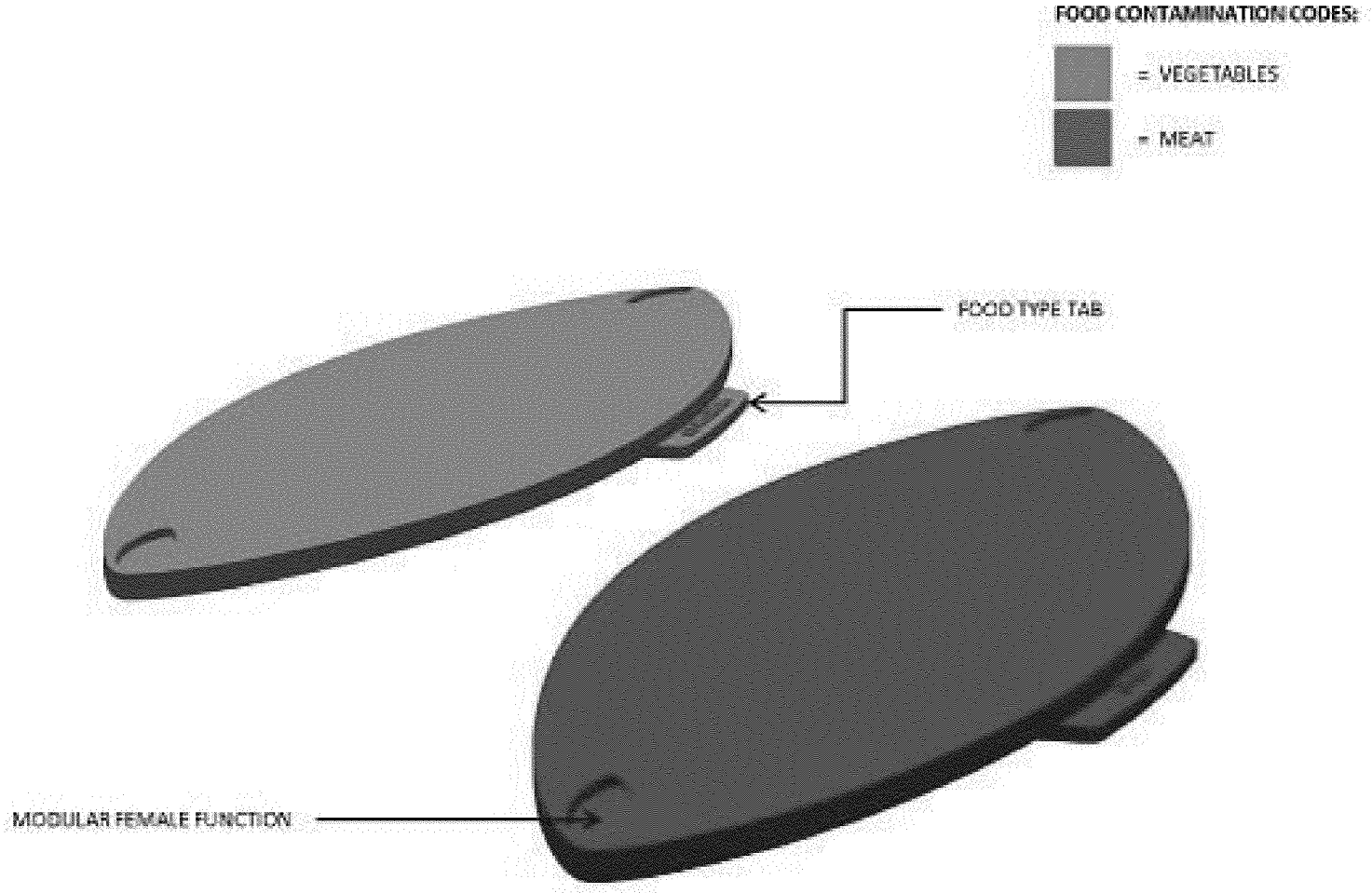
FIG. 4 is an enlarged perspective view of chopping boards of the system shown in FIG. 1.
Figure 5:
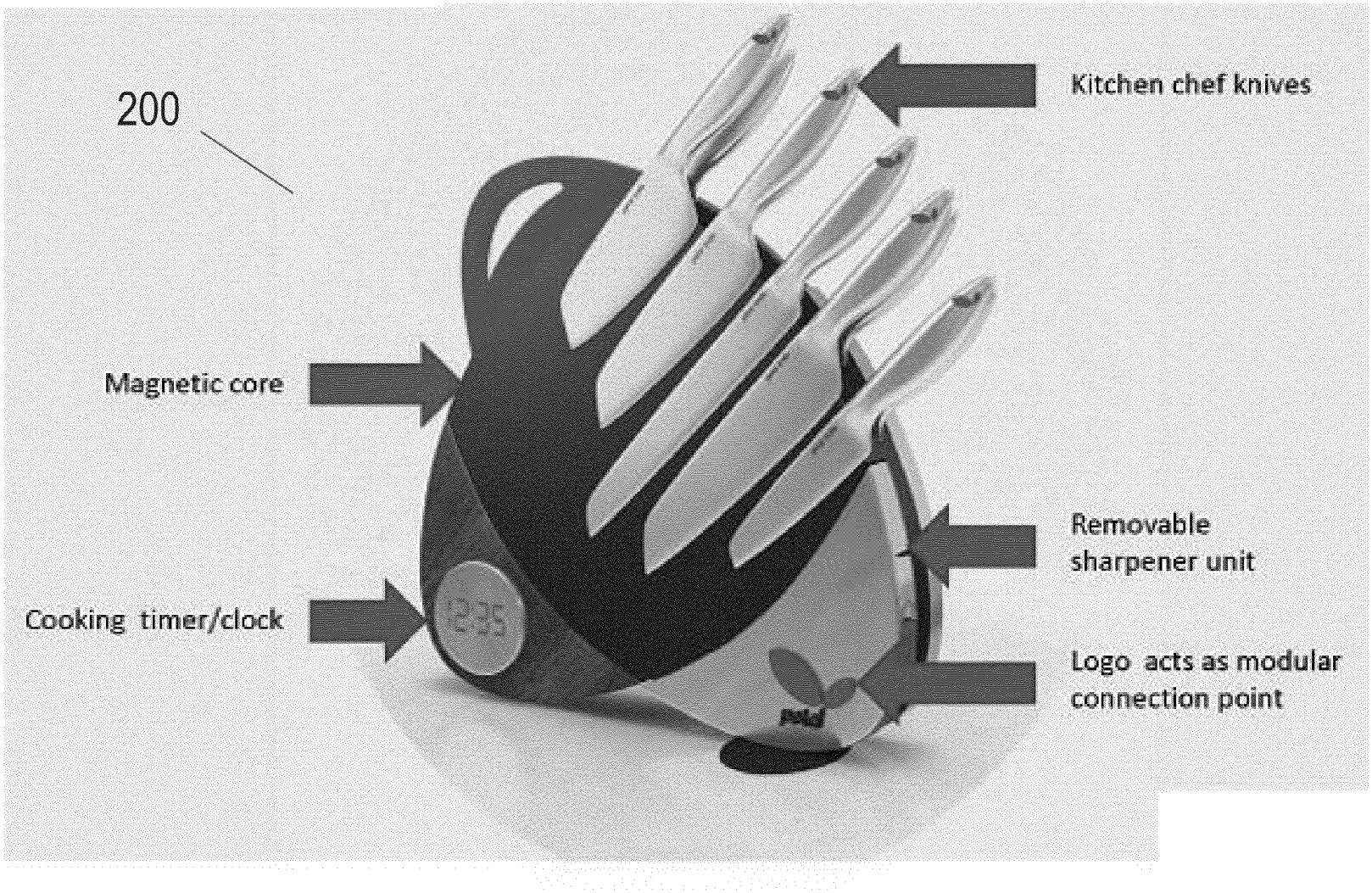
FIG. 5 is a front perspective view of a knife block system according to another example embodiment.
Figure 6:
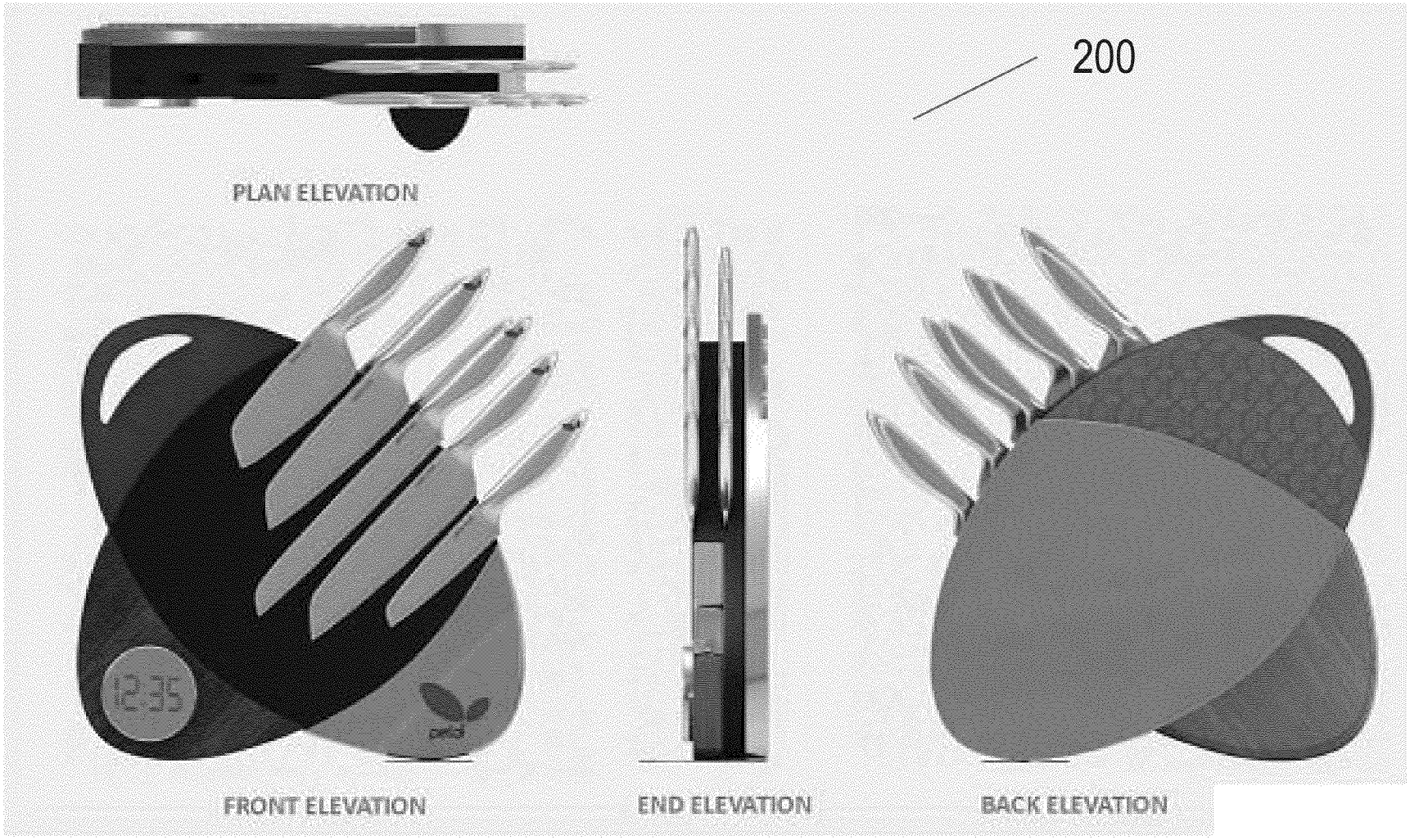
FIG. 6 are plan, front, end and back views of the system shown in FIG. 5.

FIG. 1 is a front elevational view of a knife block system according to an example embodiment; FIG. 2 is an exploded parts view of the system of FIG. 1; FIG. 3 is view of the sharpener unit and a chopping board to illustrate the interface there between in more detail; and FIG. 4 is an enlarged perspective view of the meat and vegetable chopping boards of the system shown in FIG. 1.

Referring to FIGS. 1-4, system 100 is shown and described as indicated by the reference descriptors annotating these figures. A plurality of knives is positioned within slots of a block unit that is supported on a balancing foot. A glass cover overlay is positioned on the block unit, the cover including indicia labeling the knives and providing a clear display of the knives there behind. A pair of removable chopping boards, each identified by tabs (by food type, e.g., meat and vegetable) protruding therefrom fit into a chopping board back support, as shown, behind the block unit. The tabs facilitate removal of a board from the back support.

The sharpener unit is removable from the foot and has a male connector on a surface thereof. This male connector mates with a female module on either chopping board, as shown in FIGS. 3 and 4, for example, so as to connect the sharpener unit securely to a chopping board in preparation for sharpening one or more of the knives.

Various components of system 100 (and in later described embodiments) can releasably connect or couple to one another by various engagement means not limited to what is shown in the figures, such as by snap fit engagement, slide on engagement, magnetic coupling, etc. Selected examples may include but are not limited to sharpener unit to balancing foot, sharpener to chopper board, male connector to female module, knives to block unit, chopping boards to back support, etc.

The material construction of one or more of the block unit, chopping boards, foot, sharpening unit and back support may be of a plastic, composite wood/plastic, metal/aluminum or alloy thereof, silica-based material, rubber component, food-grade nylon, food-grade silicon, inorganic, any one of the aforementioned materials with additional anti-microbial and/or anti-bacterial properties and/or agents incorporated therein, or one or more natural or organic materials, one example being bamboo with inherent anti-microbial and/or anti-bacterial properties, recycled materials, and/or one or more combinations of these example materials. Any one of the following example embodiments described hereafter may include one or more components made from one or more of these example materials.

Different components in the system may be made of the same or different materials. The individual components may be made by an injection molded process. Example processes may include over-molding, insert molding, co-injection molding, etc. The forming process for the constituent components of system 100 however is not limited to injection molding as other manufacturing methods known to one having ordinary skill in the art, such as a compression process and/or an extrusion process may be used to form the components of system 100.

FIGS. 5-11 are directed to another example knife block system 200. System 200 is similar in some respects to system 100; accordingly, the differences are noted in the figures and shall be briefly explained hereafter.

Referring to FIGS. 5-11, system 200's block unit includes a magnetic core that may secure a number of knives thereto or therein (shown as two rows) in lieu of a glass cover. Individual knives may or may not include indicia thereon indicating type of use. The sharpener unit is removably coupled to the foot (such as by snap fit engagement, slide on engagement, magnetic coupling, etc.) and includes a logo thereon that acts as a modular connection point for securing the sharpener unit by any of the aforementioned engagement means) on a chopping board, which has a corresponding female module sized to the logo shape, as shown best in FIG. 11.

Figure 9:
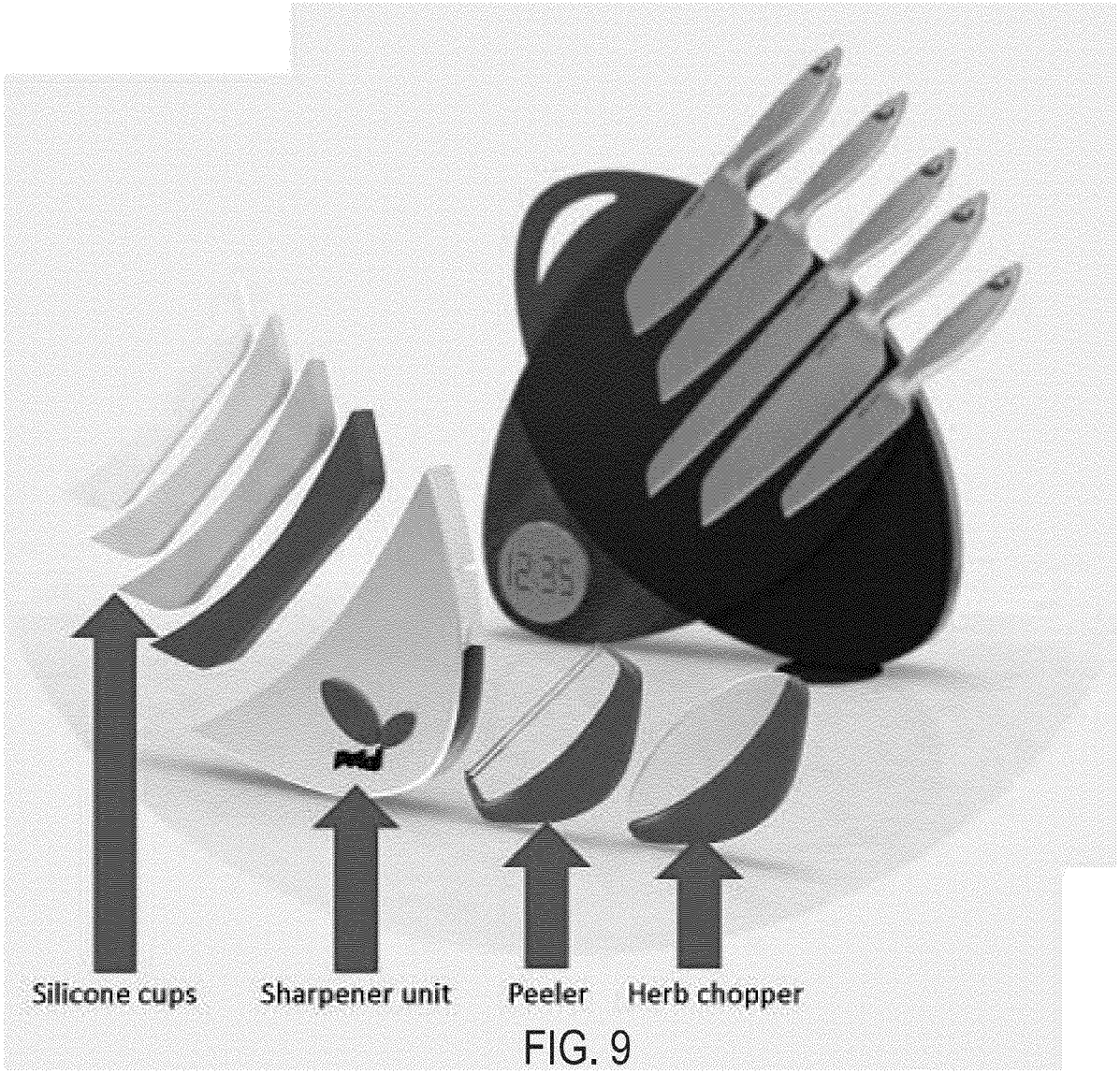
FIG. 9 is partial exploded view of selected components of the system of FIG. 5.
Figure 10:
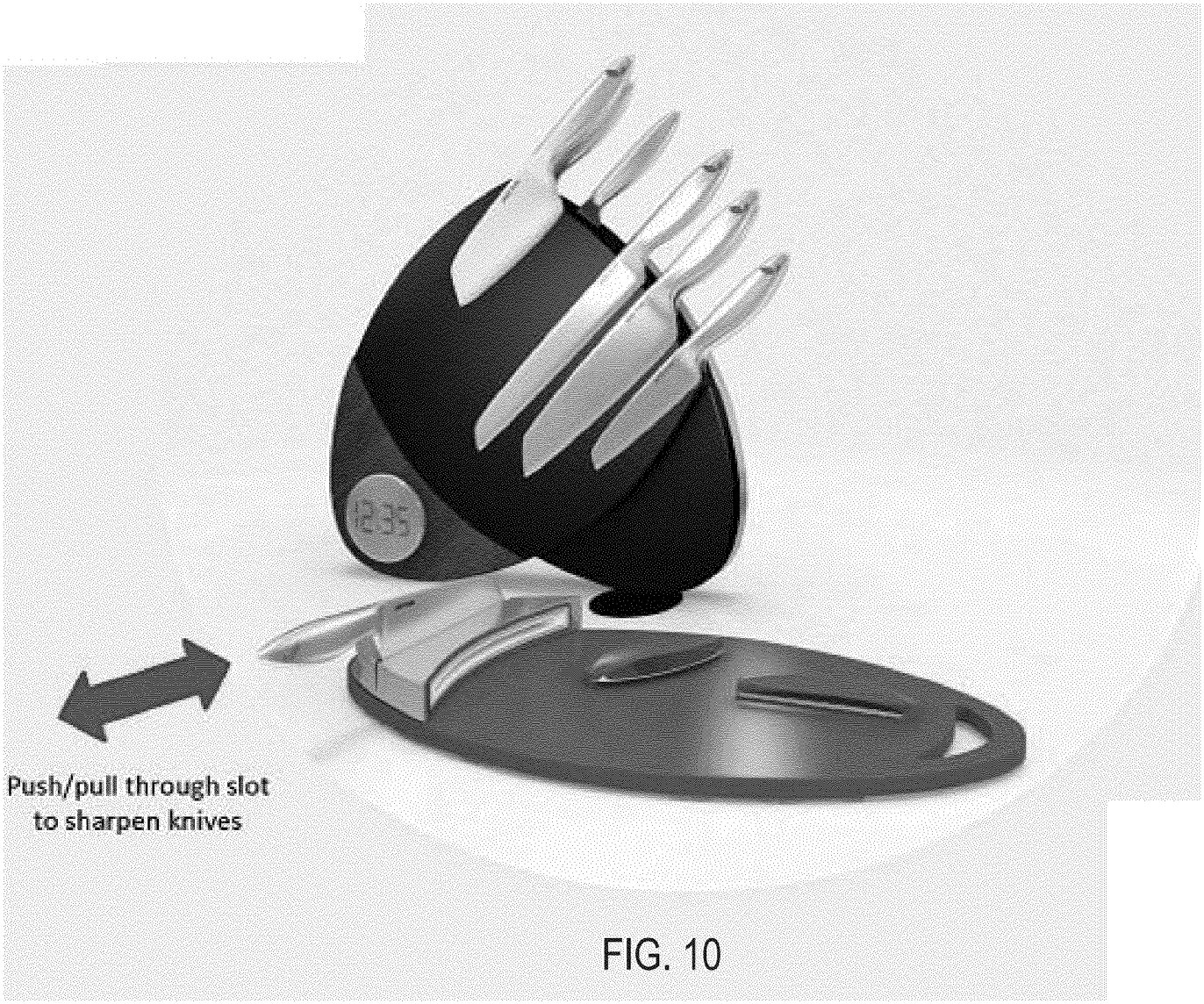
FIG. 10 is a plan view of the sharpener unit positioned on the chopping board according to the system of FIG. 5.
Figure 11:
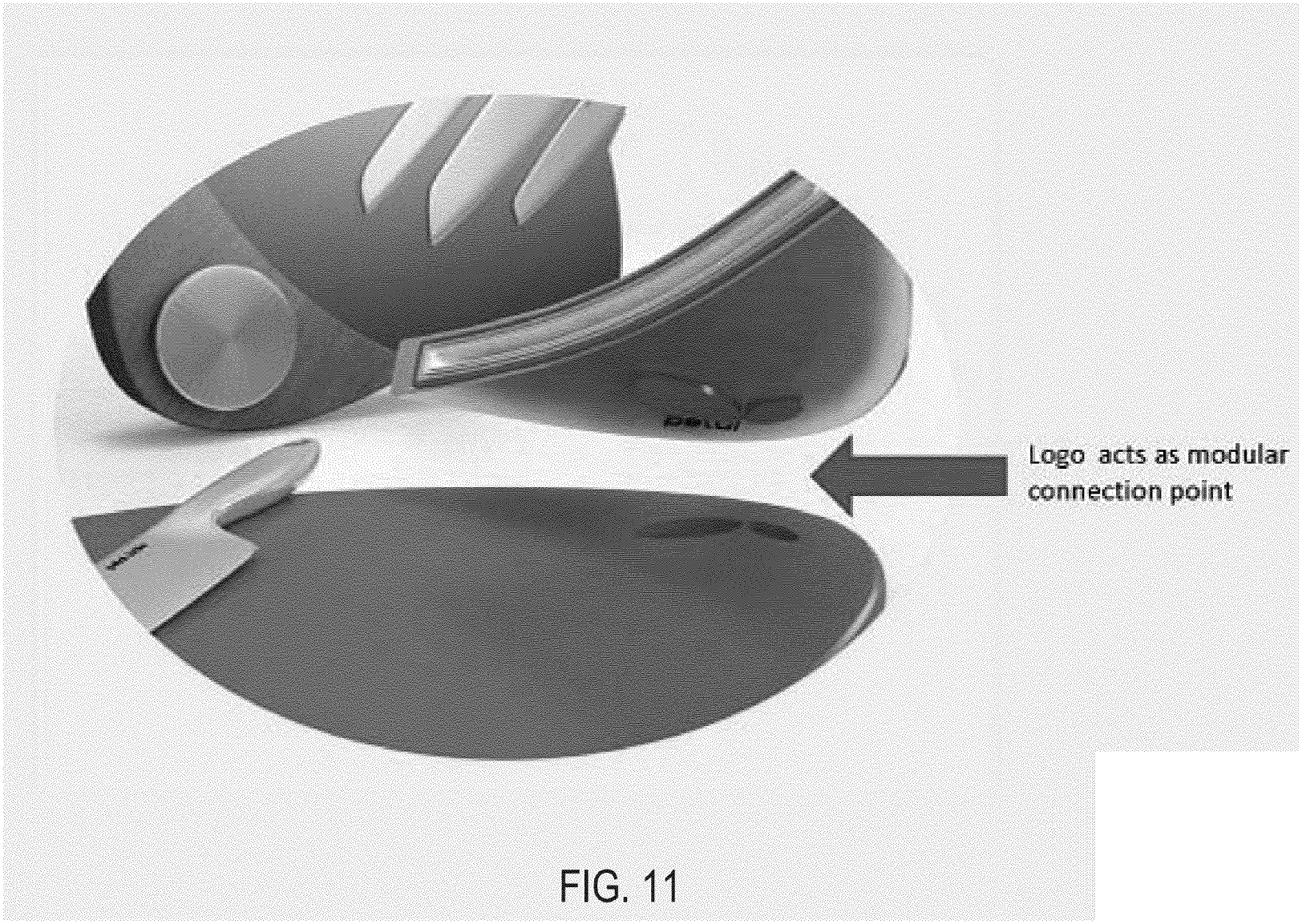
FIG. 11 is an enlarged close-up view illustrating the connective engagement between sharpening unit and chopping board in the system of FIG. 5.

The sharpener unit includes a recess on either edge thereof (FIGS. 6, 9, 10, 11), one of which is designed to house peeler and chopper accessories, the other to house a plurality of concentric measuring cups, as best shown in FIG. 9. The sharpener unit includes a groove on a surface therein for sharpening knives. Additionally with reference to FIG. 9, the various accessories/tools may be removed from either side of the block unit, depending on design thereof.

The block unit includes several extra utility slots (FIG. 7) along an upper side thereof. The lower part of the block unit includes a removable clock/timer thereon. The clock/timer can be held by magnetic attraction for example, and/or may snap fit engage or slide on engage to the block unit.

Figure 7:
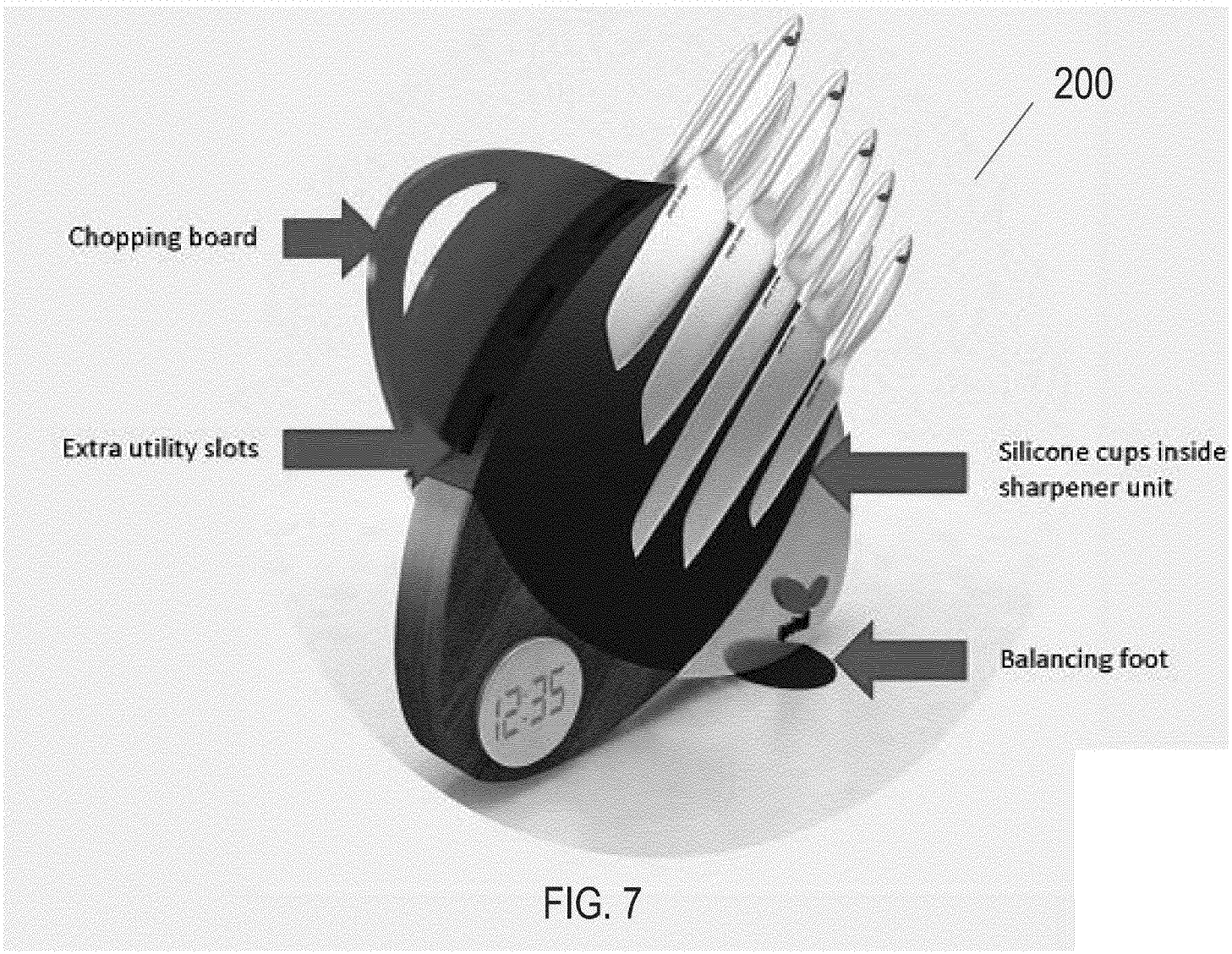
FIG. 7 is a rotated front view of the system of FIG. 5 to illustrate additional features thereof.
Figure 8:
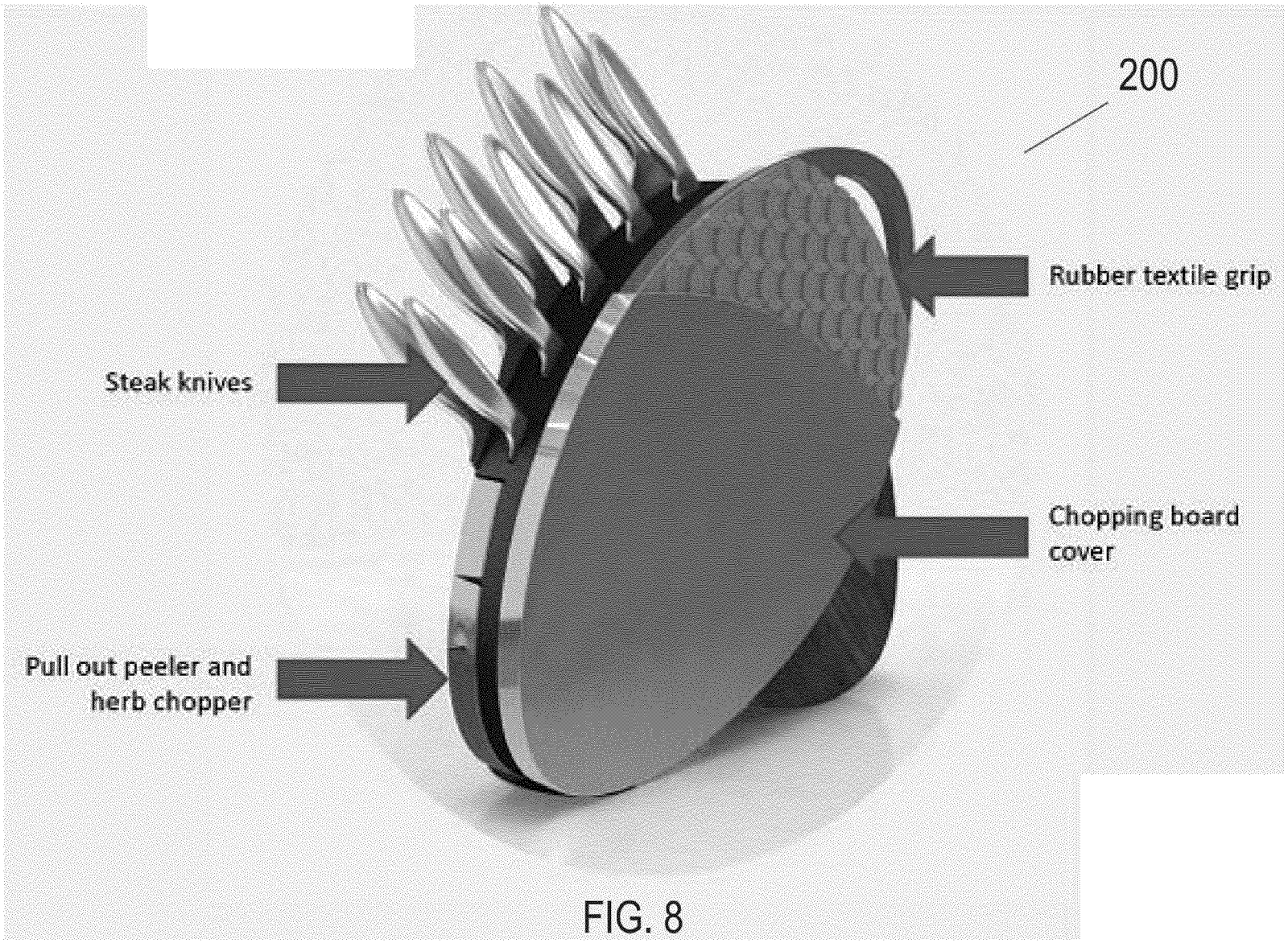
FIG. 8 is a perspective rear view of the system of FIG. 5 to illustrate additional features thereof.

As shown in FIG. 7, and similar in function to FIG. 2, the balancing foot is designed to balance the system 200 and maintain stability as it will be top heavy when knives are loaded in the block unit. However, in another configuration the balancing foot could be expanded as a base extending along the entire axis of the system design or perpendicular thereto.

As will be described in more detail hereafter, the system 200 (and later embodiments as well) may include smart electronics to wirelessly communicate with electronic devices thereon and/or other remote smart devices such as smart phones, smart ovens and refrigerators. The clock/timer for example may be configured to automatically set itself wirelessly, and the timer unit could communicate with a smart phone or other device to alert the user of the status of cooking or pre-heating of an oven.

The clock/timer may also act as an internal temperature and external temperature indication device that can show the temperature outside (with wireless sensor) and inside temperature with onboard sensor. Additionally, the clock/timer may be configured to display a calendar with date and time, and may be programmed to access remote data (via a wireless or wired internet connection) so as to display future weather forecasts. The calendar may be configured to sync over the internet or wirelessly to the user's daily planning calendar to help in planning their day, much like a smart phone's calendar. As many people start their day in the kitchen and desire this information, weather alters, daily calendar notifications and synching may be important.

The chopping board may include a rear rubber grip surface, a smooth chopping surface, and a grip handle. In an example, the chopping board shown in this, any of the previous or follow-on embodiments may include an extra layer of material such as food grade silicon on a back side thereof to provide a friction effect when in use on a planar surface such as a table. The chopping board is retained within system 200 by a chopping board cover, somewhat similar to the back support in system 100.

Figure 12:
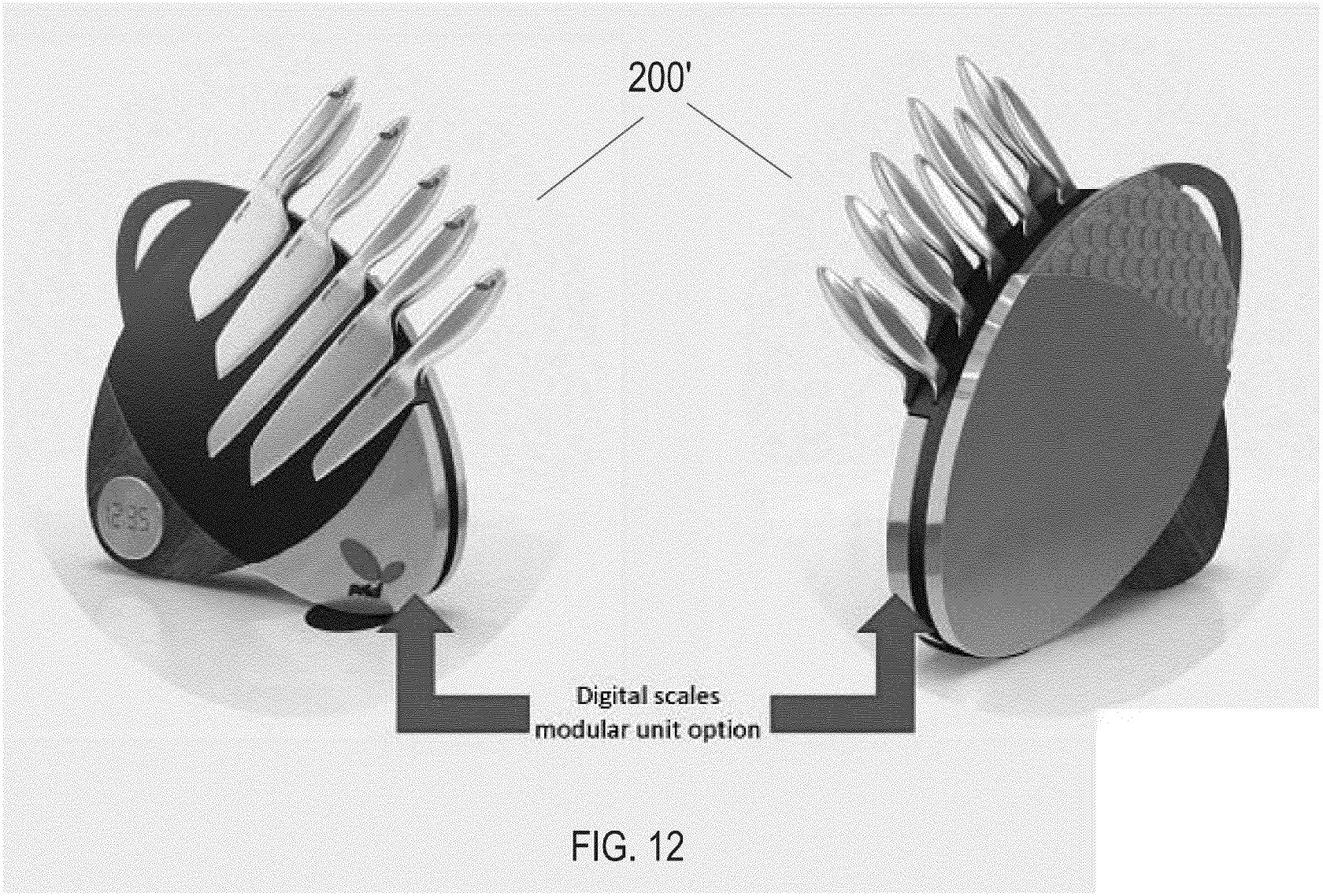
FIG. 12 shows elevational front and rear views of a knife block system according to another example embodiment.
Figure 13:
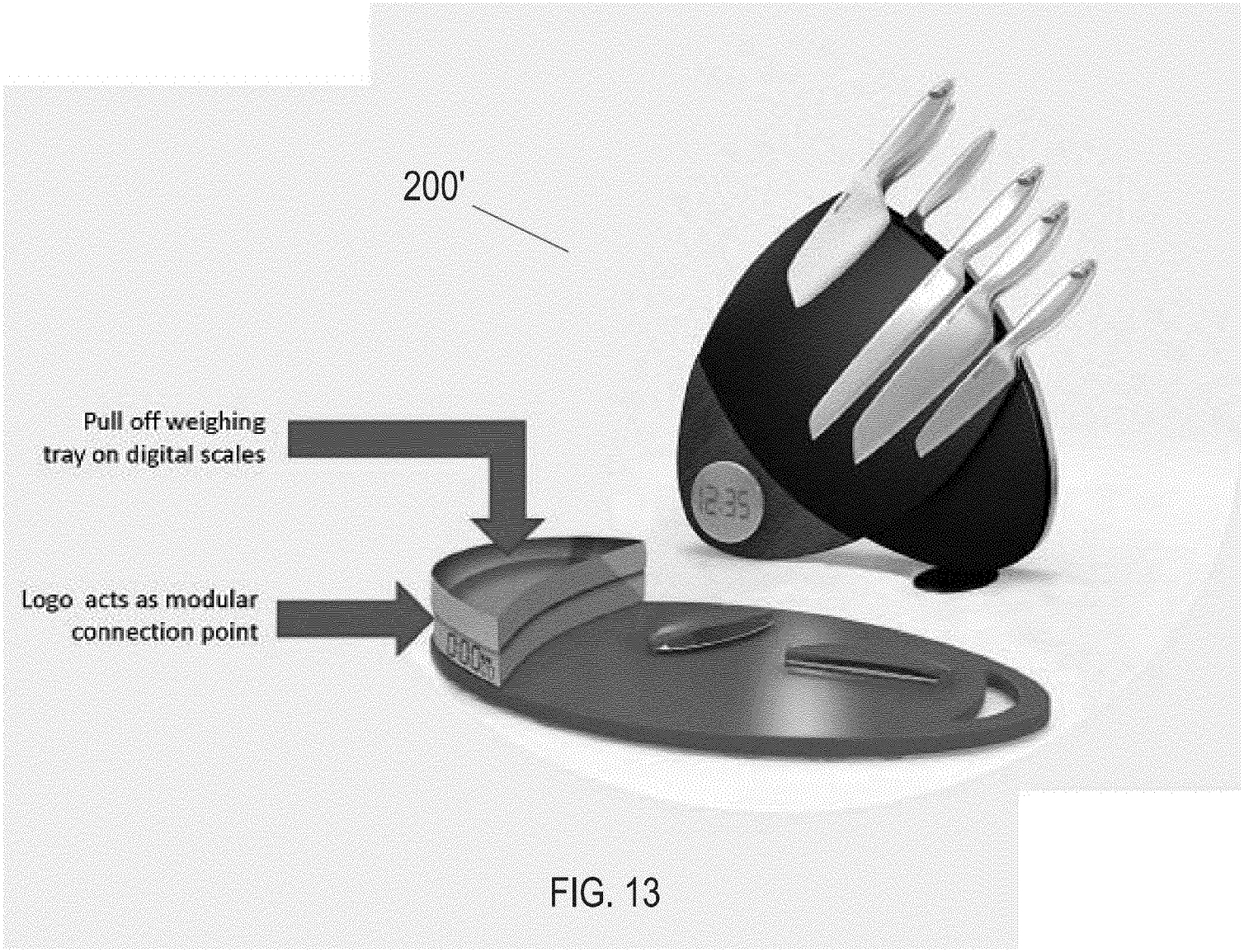
FIG. 13 is a plan view of the digital scale positioned on the chopping board according to the system of FIG. 12.

FIGS. 12 and 13 are directed to another example knife block system 200'. System 200' is a variation of system 200; accordingly, only the differences are noted in the figures and shall be briefly explained hereafter.

In system 200', a digital scale has replaced the sharpener unit with accompanying accessory items (cups, peeler, and chopper). Like the sharpener unit, the digital scale is removable from the foot and includes a logo thereon that acts as a modular connection point for securing the unit on a chopping board, which has a corresponding female module sized to the logo shape. The digital scale unit also includes a weighing tray, as shown in FIG. 13. The digital scale may also include smart electronics to communicate with the clock/timer and or with other smart devices such as smart phones, smart ovens and refrigerators. The scale for example may be configured to wirelessly communicate with a smart oven to pre-plan portioned measurements and list recipe amounts to coordinate a pre-planned meal.

Figure 14:
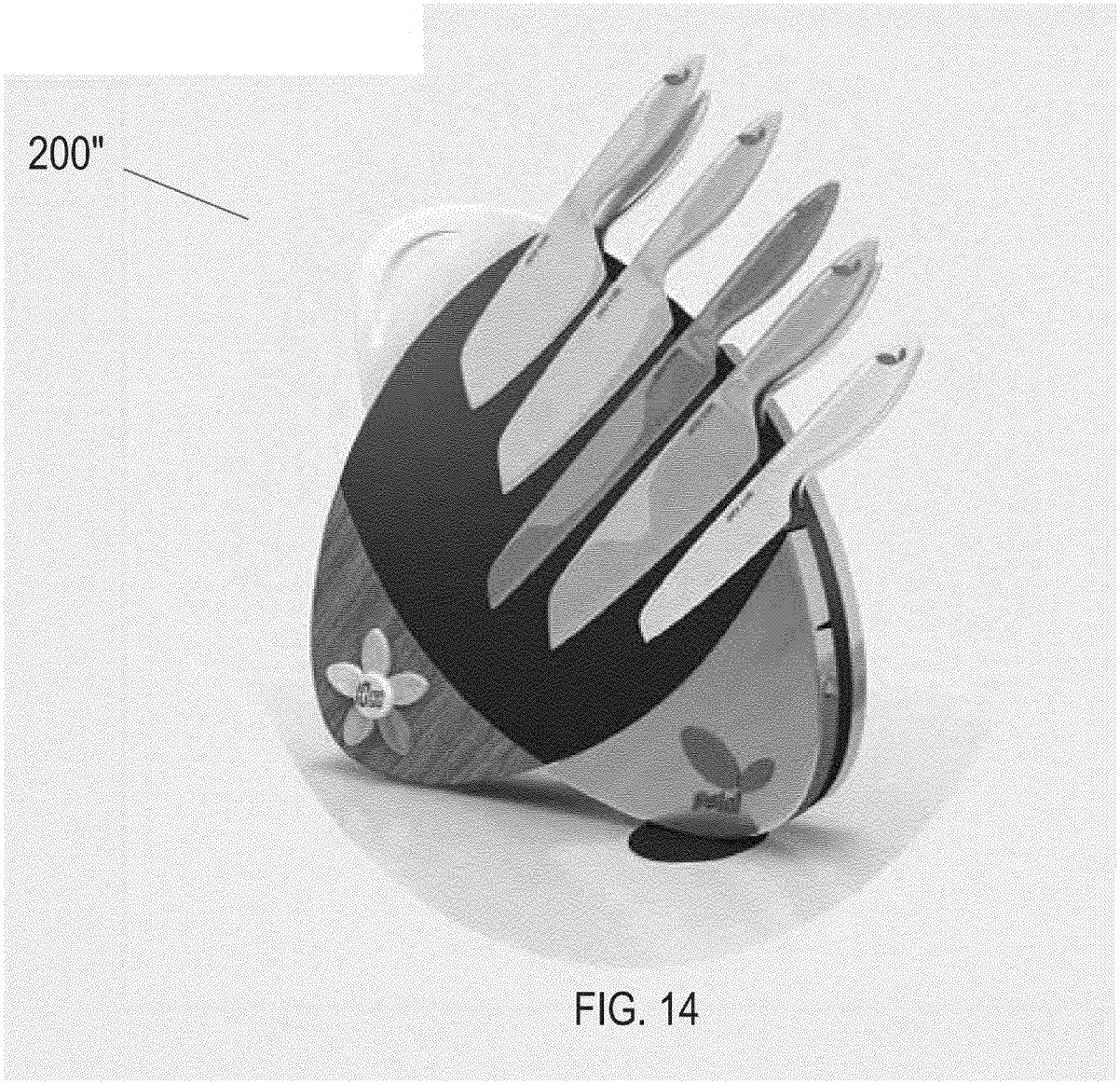
FIG. 14 is a front elevational view of a knife block system according to another example embodiment.
Figure 15:
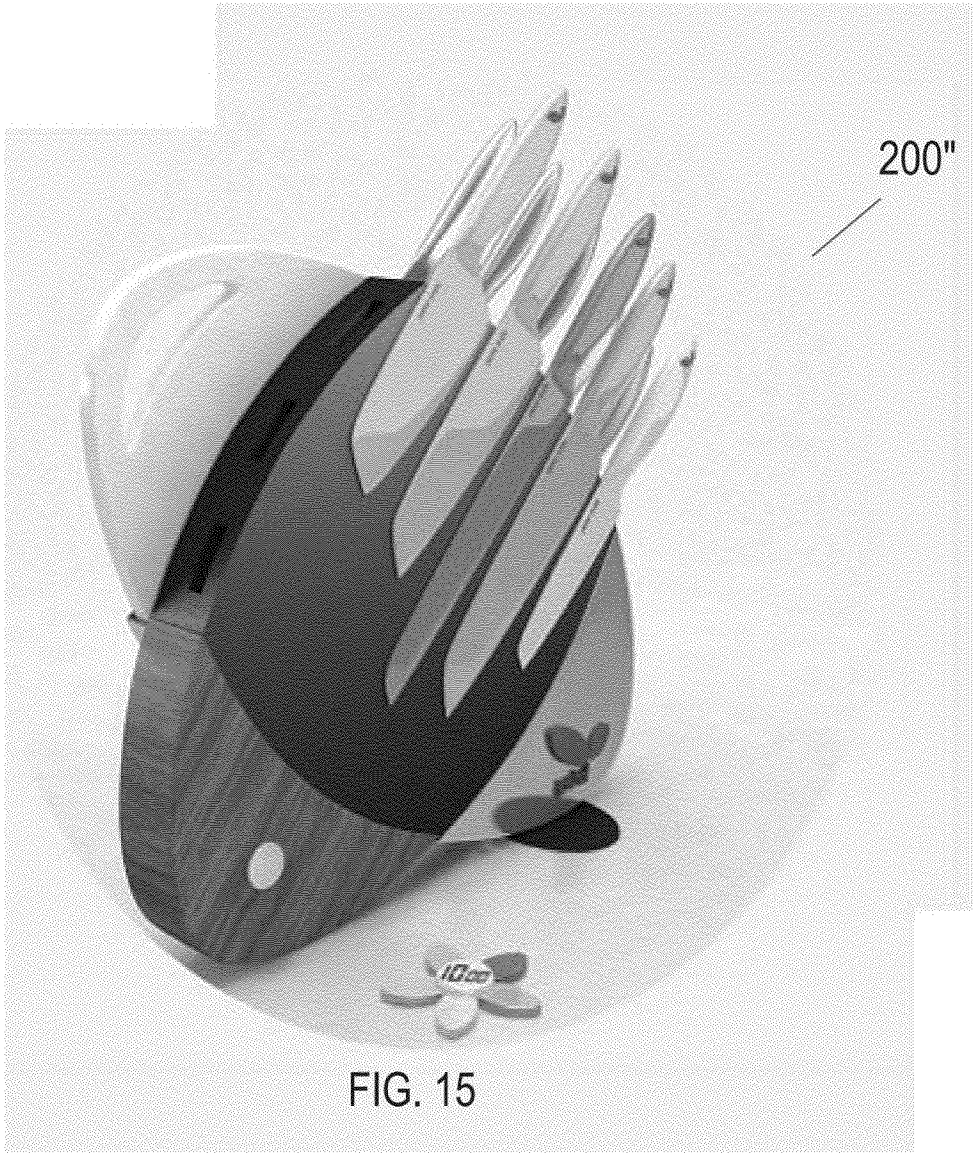
FIG. 15 is a front perspective view of the system of FIG. 14.

FIGS. 14 and 15 are directed to another example knife block system 200". System 200" is a variation of system 200'; accordingly, only the differences are noted in the figures and shall be briefly explained hereafter. In system 200", the clock/timer is different than shown in either system 200 or 200". Shown in decorative form, clock/timer is removable from a magnetic disc element on the lower part of the block unit. The space on the block unit may be a contiguous surface area of a cut out to hold the clock/timer. It may be fixed or removable as well, or as shown in FIG. 15 have a metal insert where the flower-shaped clock/timer has a magnet internal thereto, so it may be attached to other metal surfaces such as a refrigerator, oven etc. Additionally, FIGS. 14 and 15 illustrate that decorative coloring may be employed to set off the knives.

Figure 16:
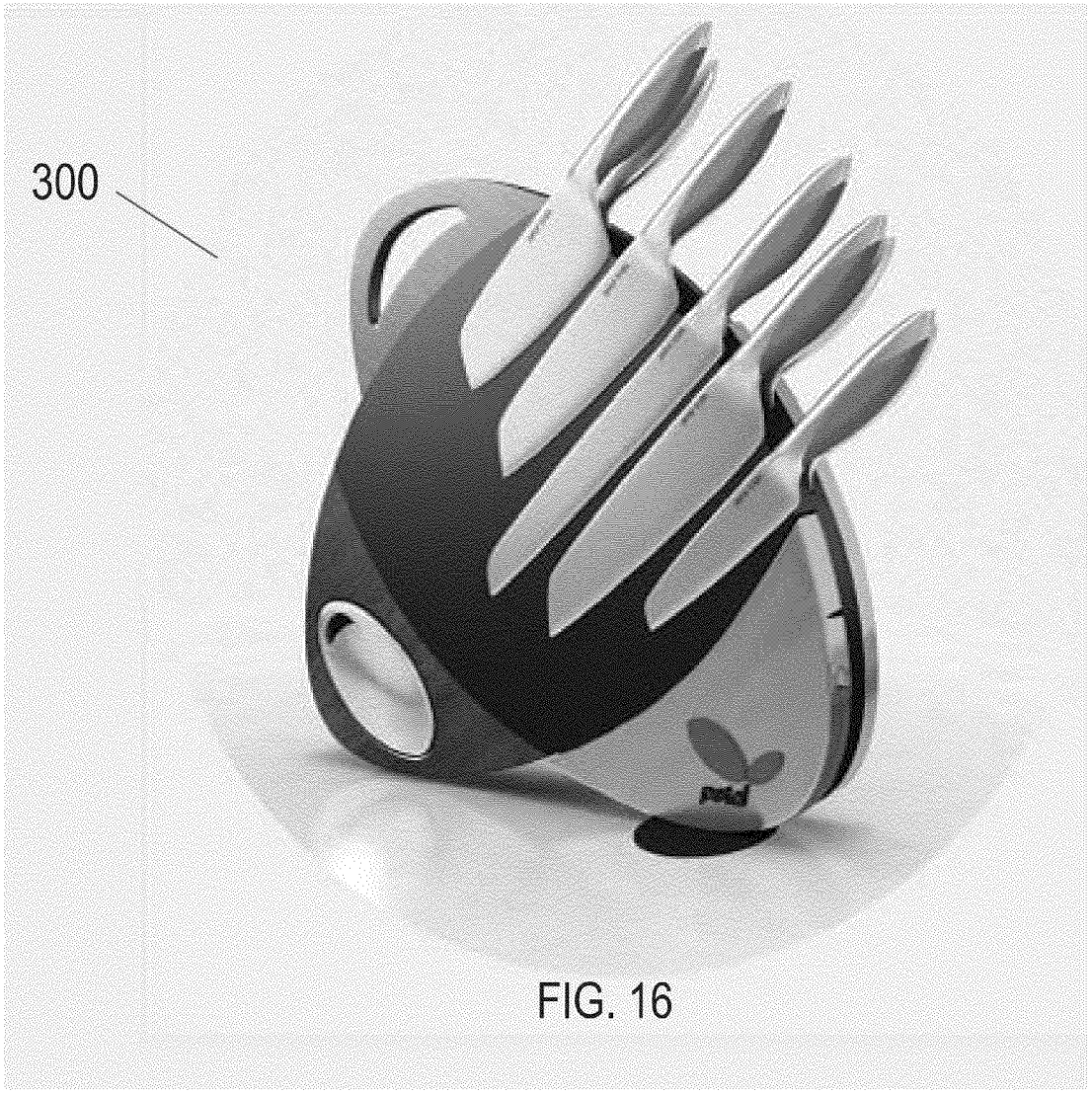
FIG. 16 is a front elevational view of a knife block system according to another example embodiment.
Figure 17:
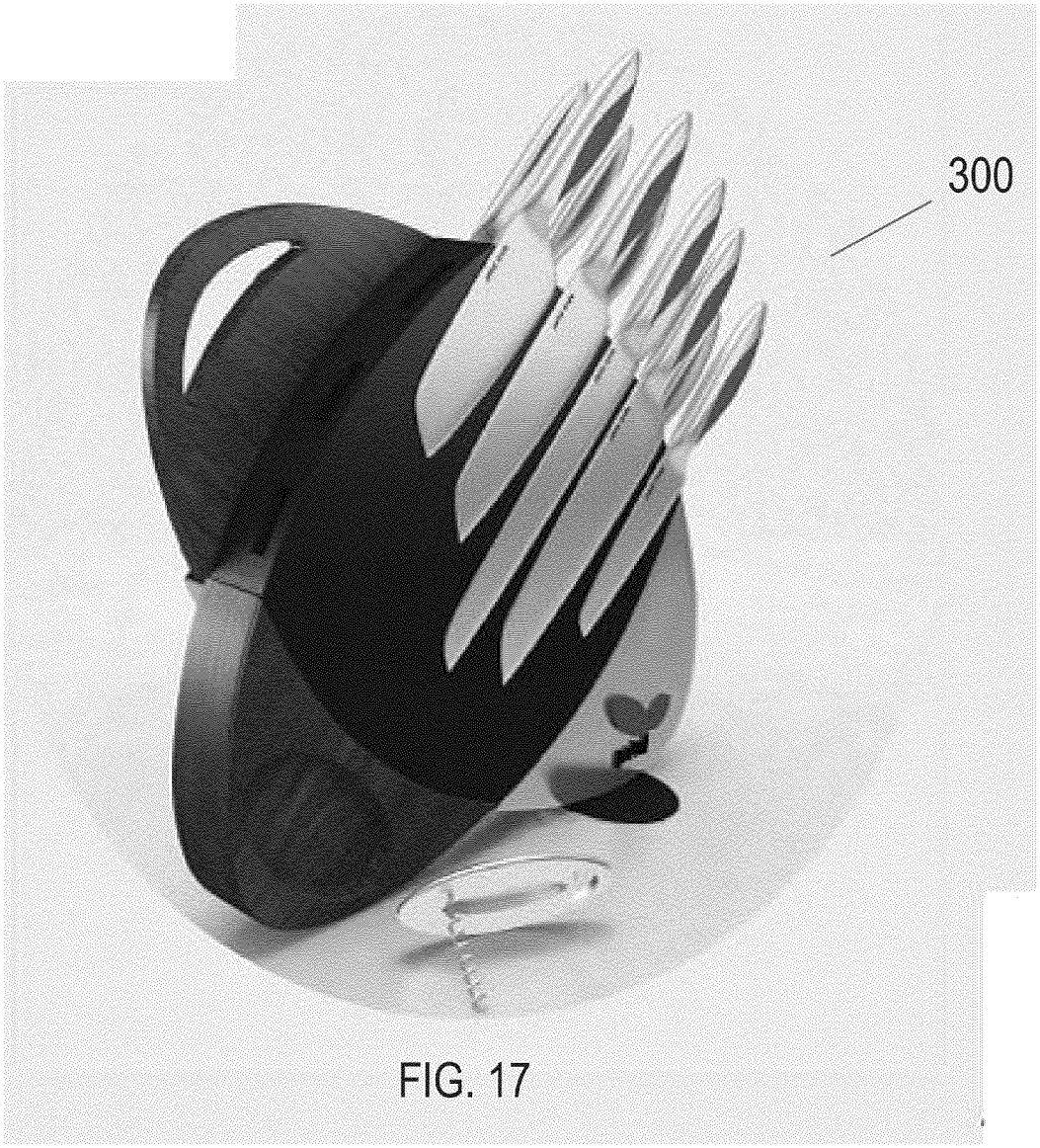
FIG. 17 is a front perspective view of the system of FIG. 16.
Figure 18:
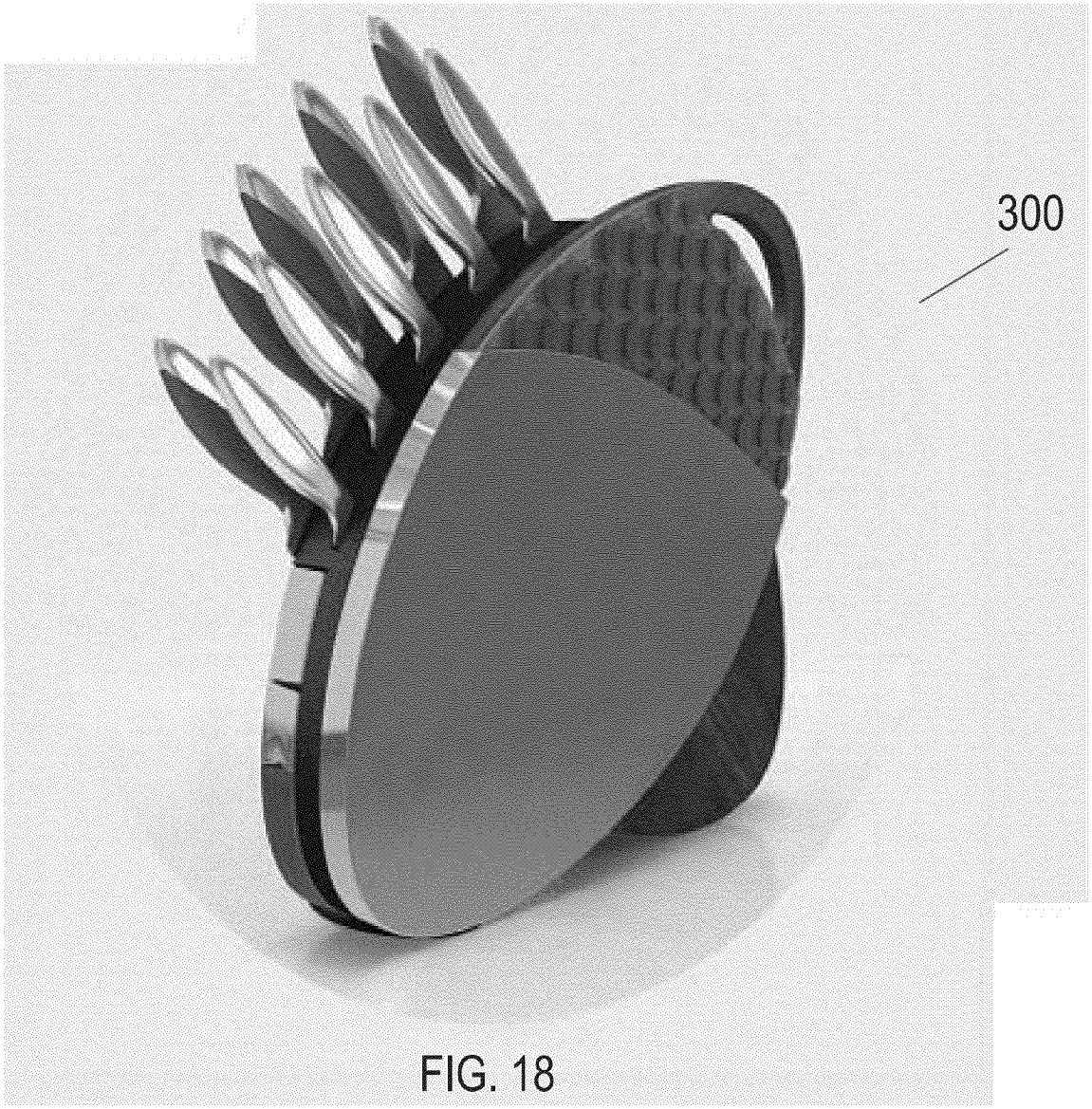
FIG. 18 is a rear elevational view of the system of FIG. 16.
Figure 19:
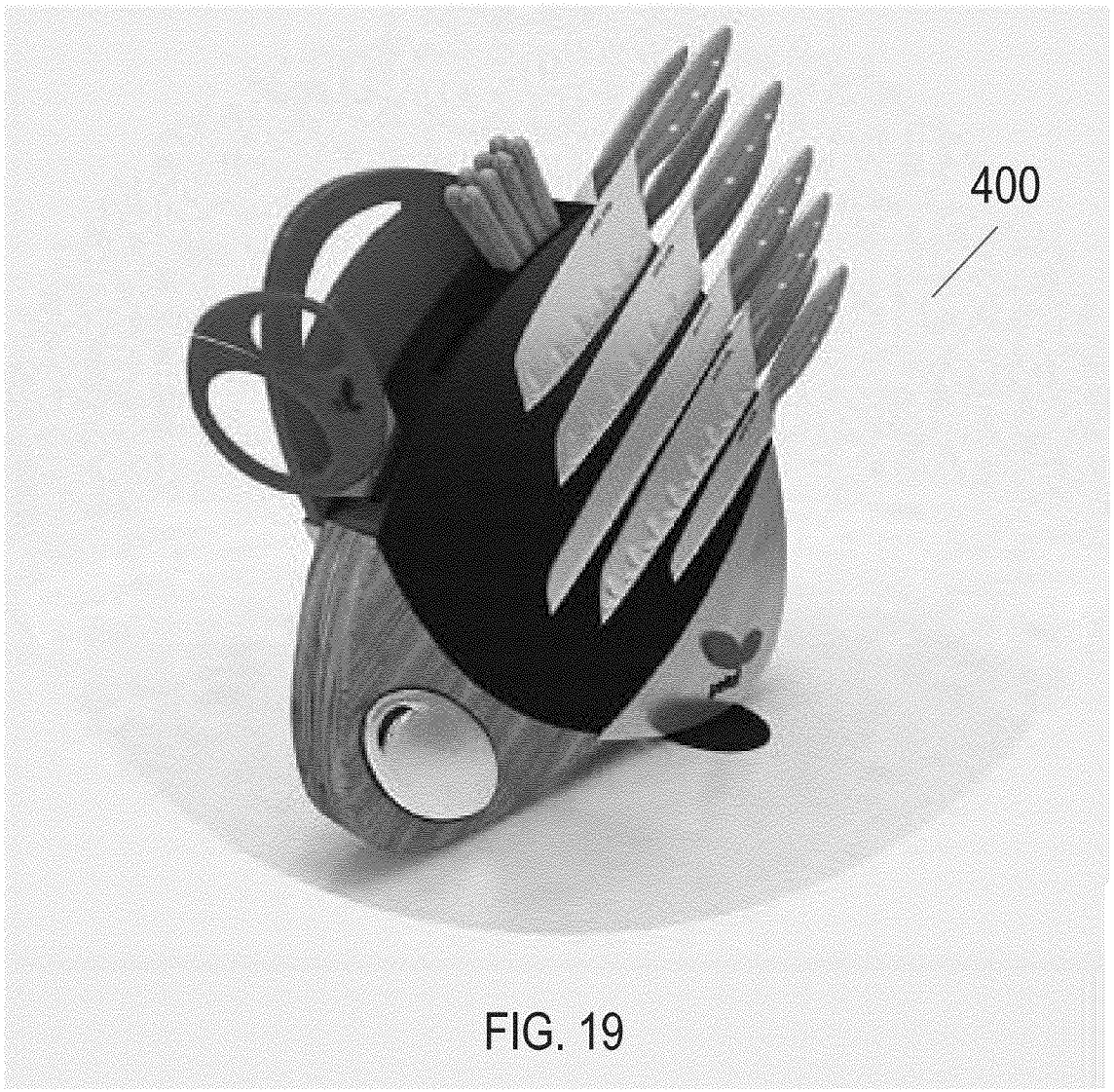
FIG. 19 is a front perspective view of a knife block system according to another example embodiment.
Figure 20:
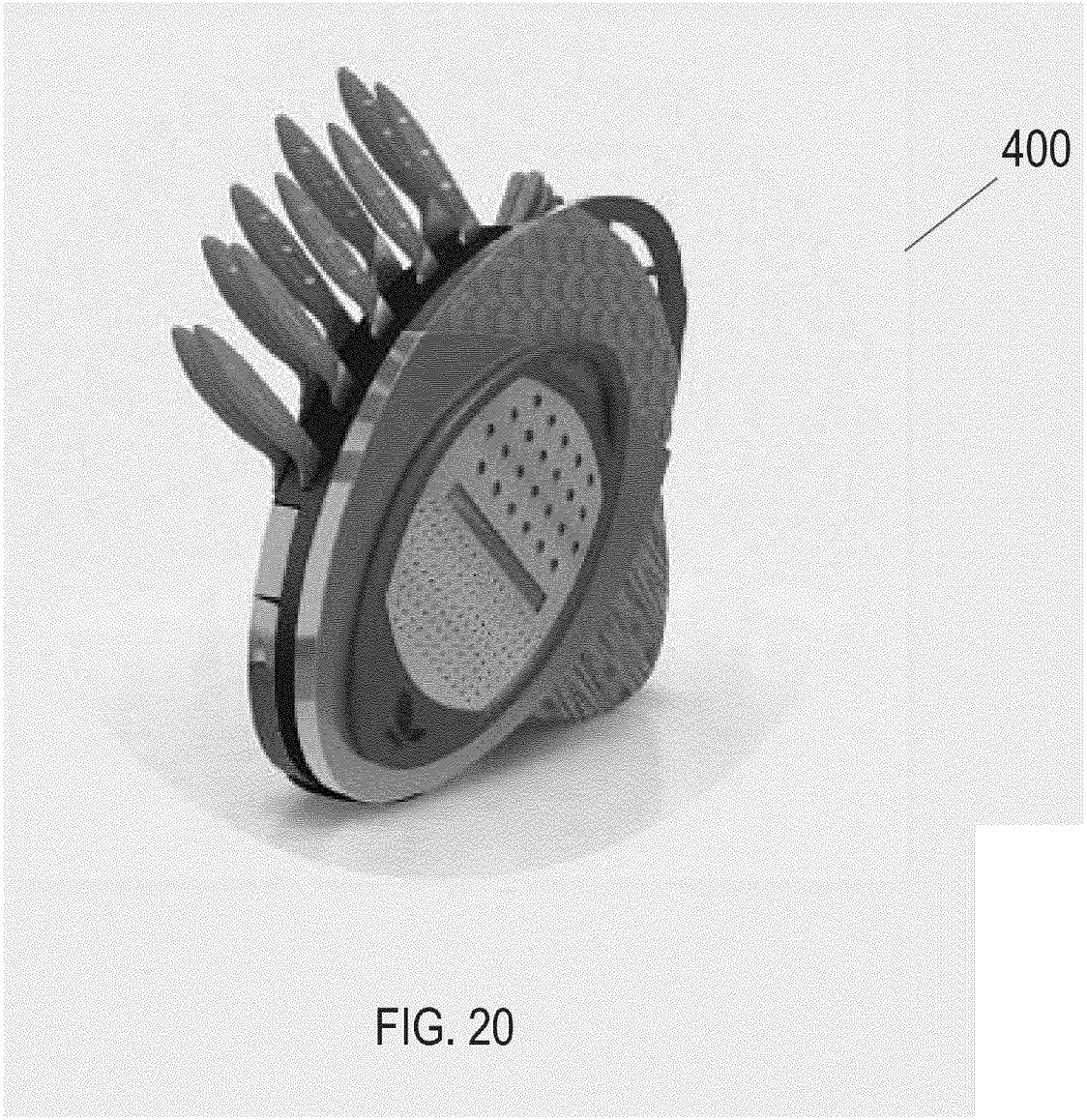
FIG. 20 is a rear perspective view of the system of FIG. 19.
Figure 21:
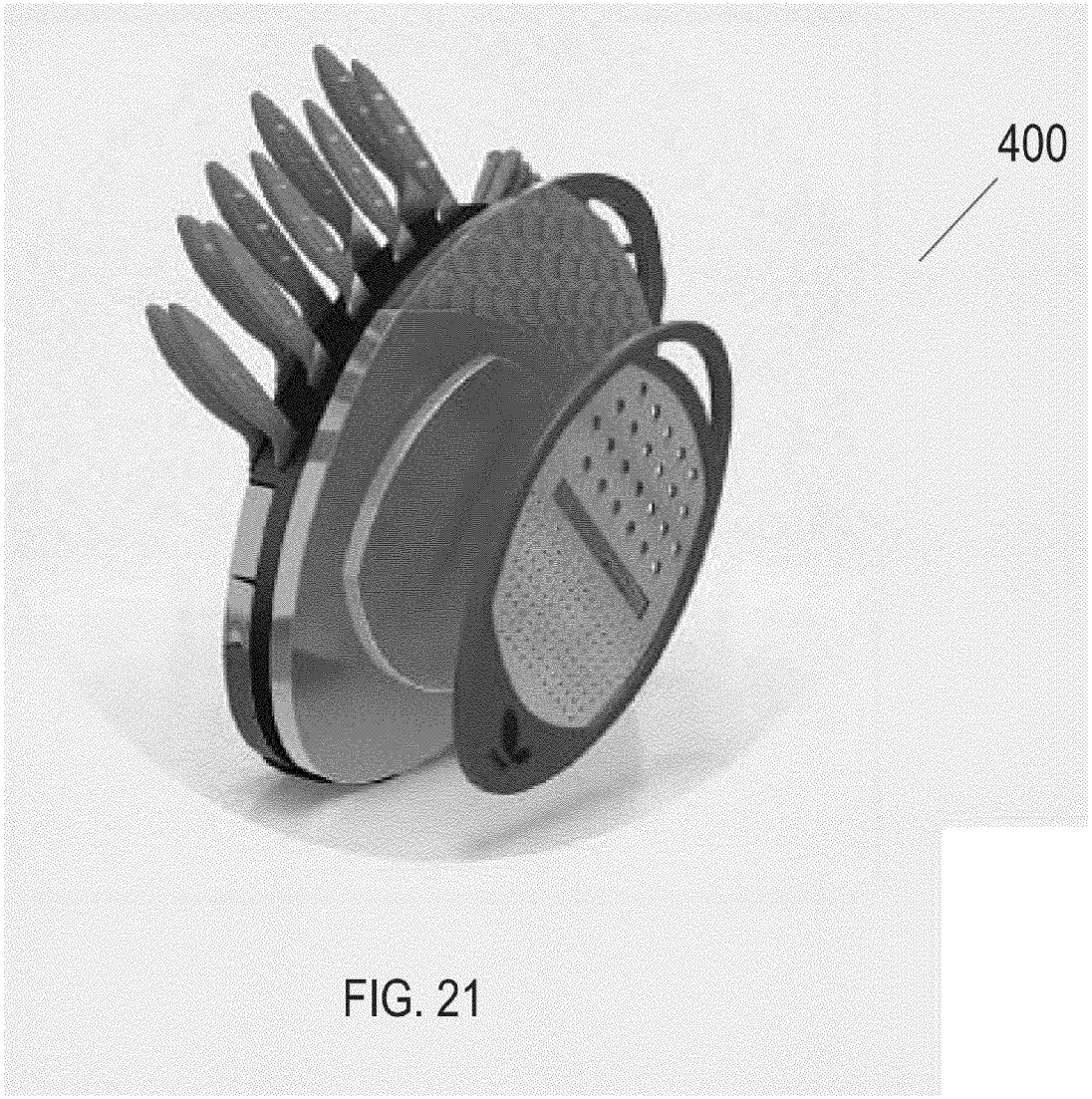
FIG. 21 is a rear perspective view of the system of FIG. 19 with the grater separated from the chopping board cover
Figure 22:
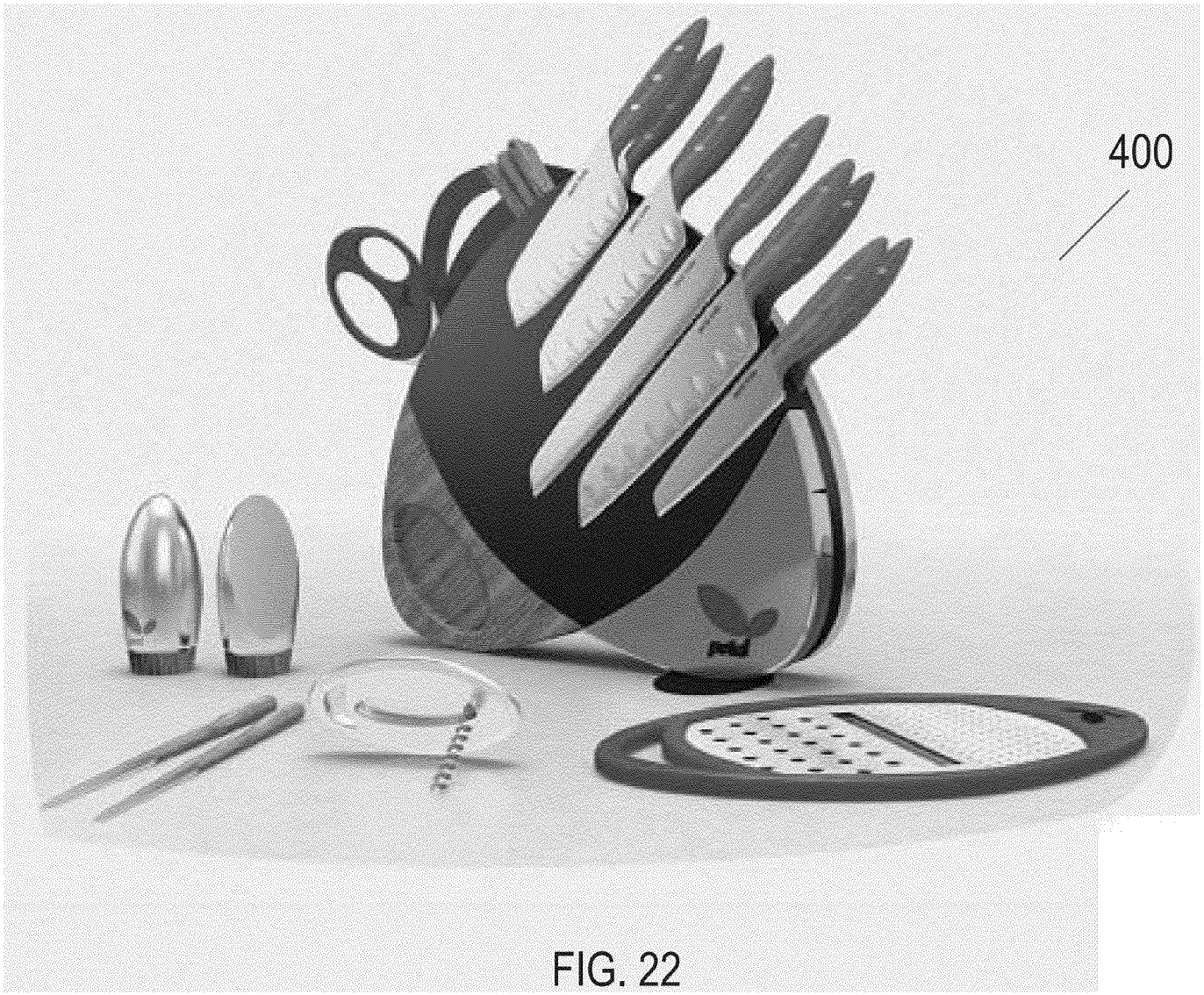
FIG. 22 is a front elevational view of the system of FIG. 19.

FIGS. 16-18 are directed to another example knife block system 300. System 300 is a variation of systems 100 and/or 200; accordingly, only the differences are noted in the figures and shall be briefly explained hereafter. System 300 includes the sharpener unit with attendant accessories as shown in the figures describing system 200. However, system 300 has a removable bottle opener accessory in place of the clock/timer on the lower part of the block unit. The bottle opener accessory may be sized to friction fit, snap fit, or interference fit into a recess formed into the block unit surface, as shown in FIG. 17, although other engagement means are foreseen, such as slide on engagement, magnetic coupling, etc FIGS. 19-22 are directed to another example knife block system 400. System 400 is a variation of systems 100 through 300; accordingly, only the differences are noted in the figures and shall be briefly explained hereafter. System 400 includes the sharpener unit with attendant accessories as shown in the figures describing systems 200 and 300, and includes the bottle opener accessory of system 300. In FIG. 19, the utility slots are shown with additional accessories such as kitchen shears and chopsticks, as well as accompanying salt and pepper grinders (FIG. 22). Unlike previous embodiments, the chopping board cover includes a shape form element sized to friction fit, snap fit, or interference fit with an additional accessory, here shown as a grater accessory, as best shown in FIG. 21, although other engagement means are foreseen, such as slide on engagement, magnetic coupling, etc.

Additionally as shown in FIG. 19, there is shown a unique functional Santoku shape (scalloping) in the knife blades that mimics the petal-shaped logo. The scallops create air pockets to allow the food to release itself when cutting. The Santoku shape permits more air release and less sticking based on the alternating angles of the scallops formed in the knife blades. This is also shown in FIG. 22.

Figure 23:
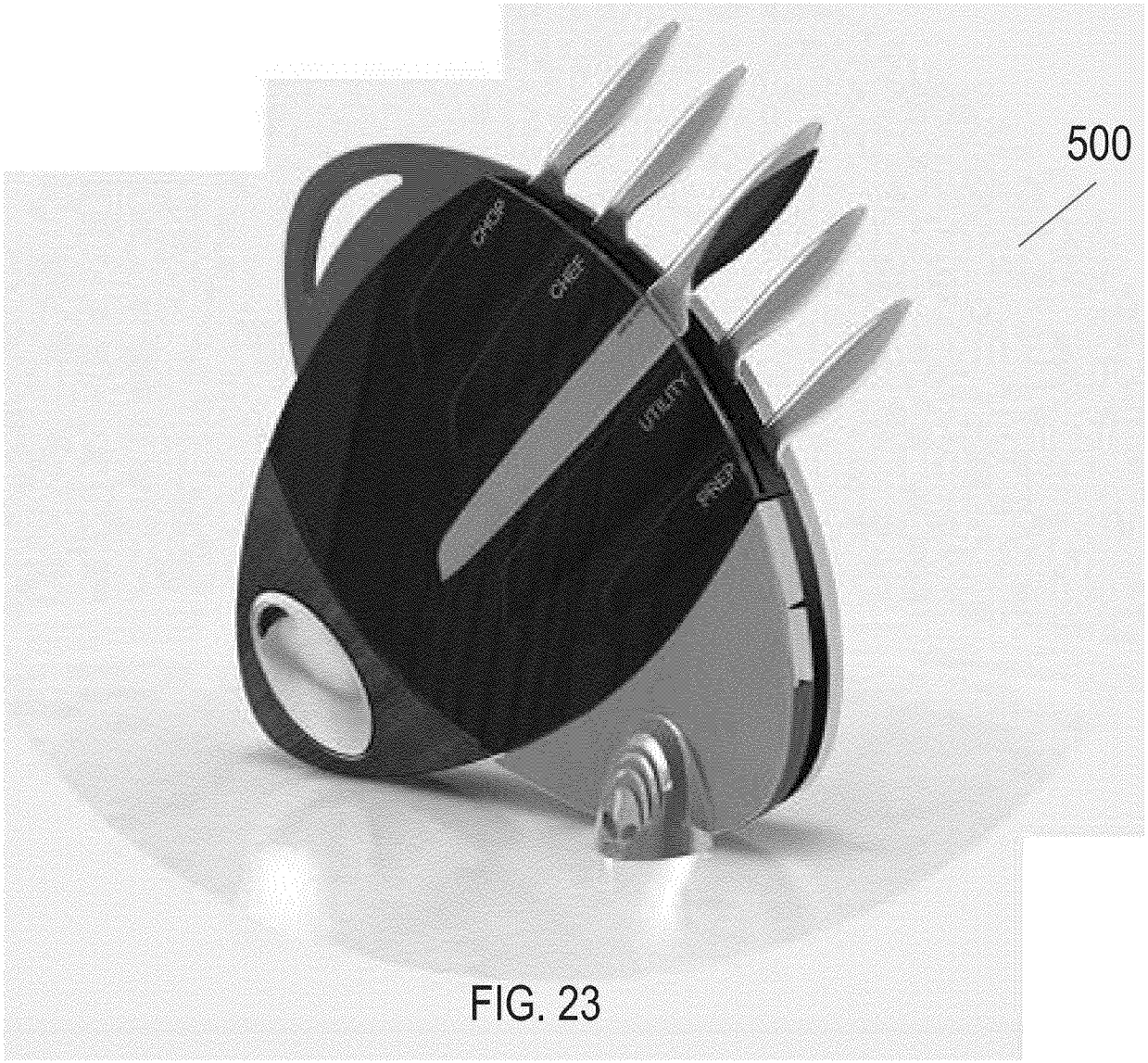
FIG. 23 is a front elevational view of a knife block system according to another example embodiment.
Figure 24:
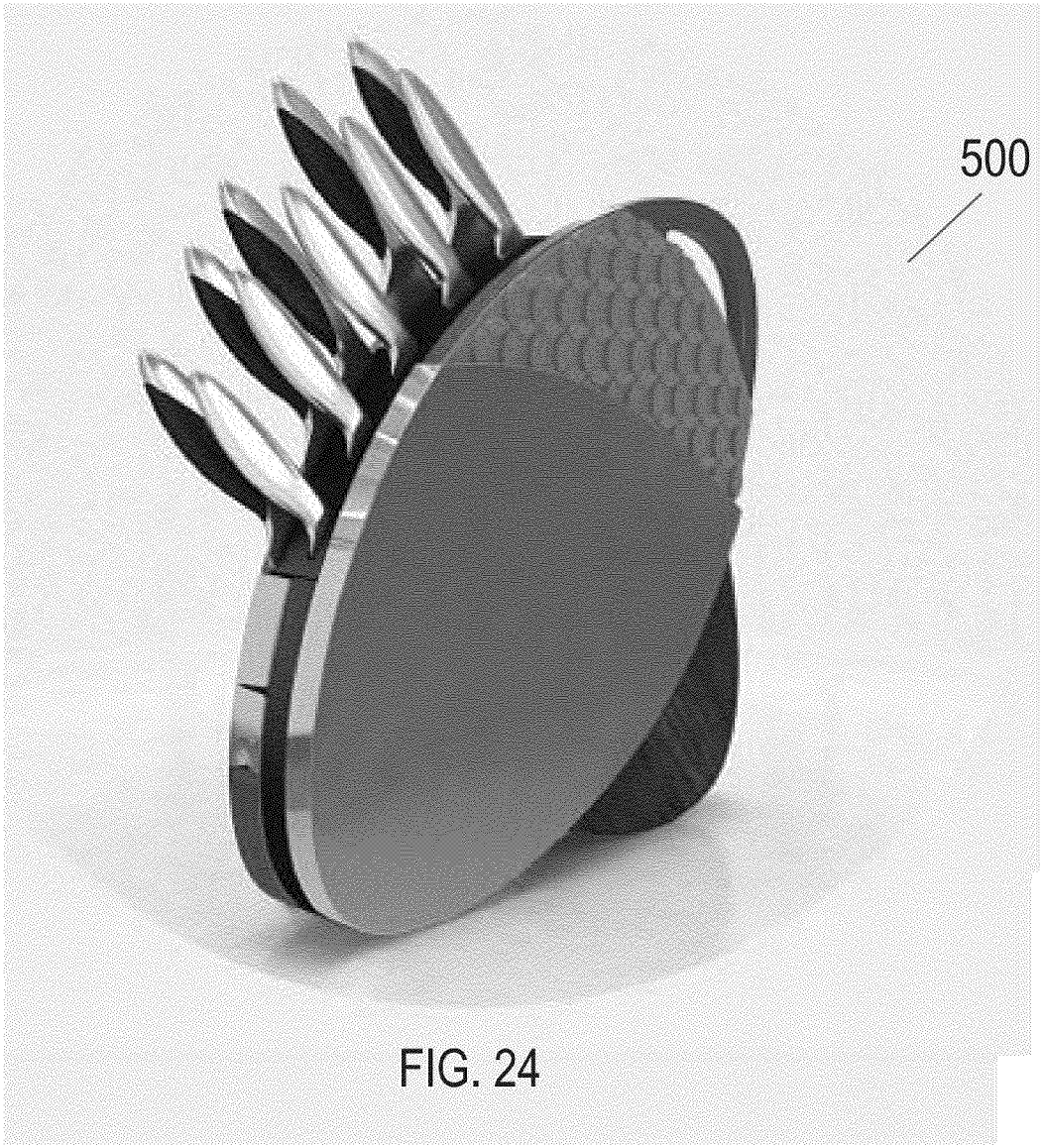
FIG. 24 is a rear perspective view of the system of FIG. 23.
Figure 25:
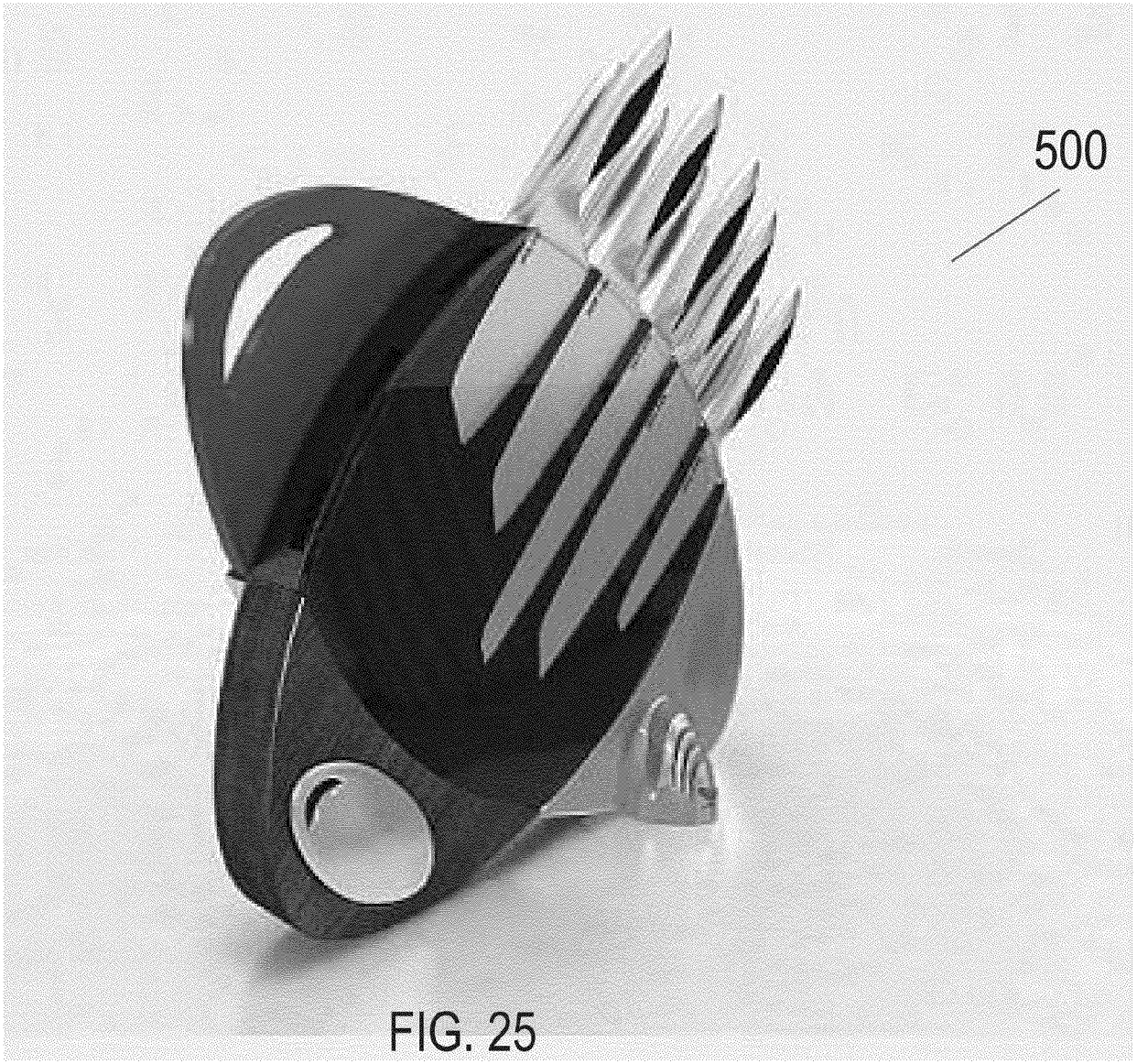
FIG. 25 is a front elevational view of the system of FIG. 23.

FIGS. 23-25 are directed to another example knife block system 500. System 400 is a variation of systems 100 through 400; accordingly, only the differences are noted in the figures and shall be briefly explained hereafter. System 500 includes the sharpener unit with attendant accessories as shown in the figures describing systems 200 through 400, and includes the bottle opener accessory of systems 300 and 400. In FIG. 23, there is shown a recipe holder as part of the sharpener unit. Additionally, and similar to system 100, a glass cover overlay is positioned on the block unit, the cover including indicia labeling the knives and providing a clear display of the knives there behind. Thus, and unlike previous embodiments in systems 200 to 400, the glass cover retains the front row of knives rather than a magnetic core in the block unit.

Figure 26:
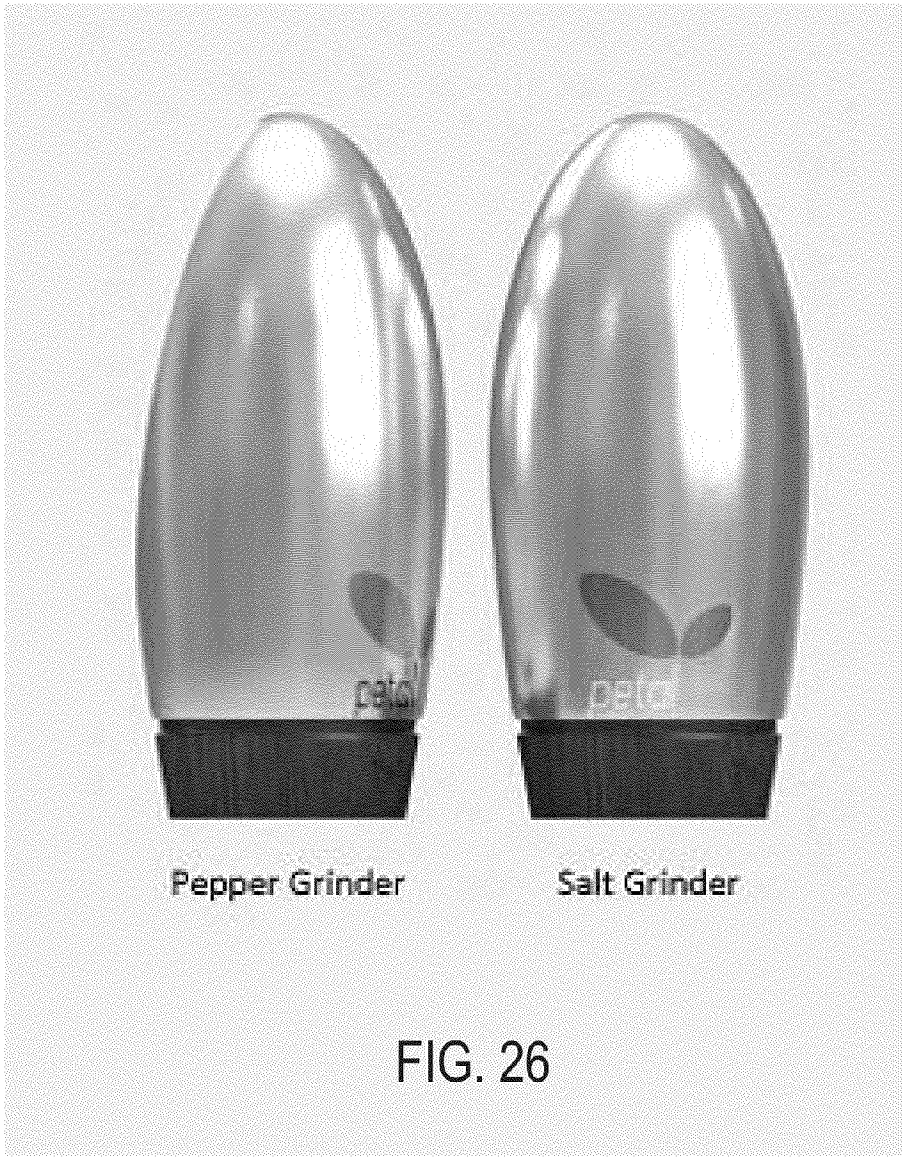
FIGS. 26 to 33 are illustrations of various accessory items usable in the knife block system described herein.
Figure 27:
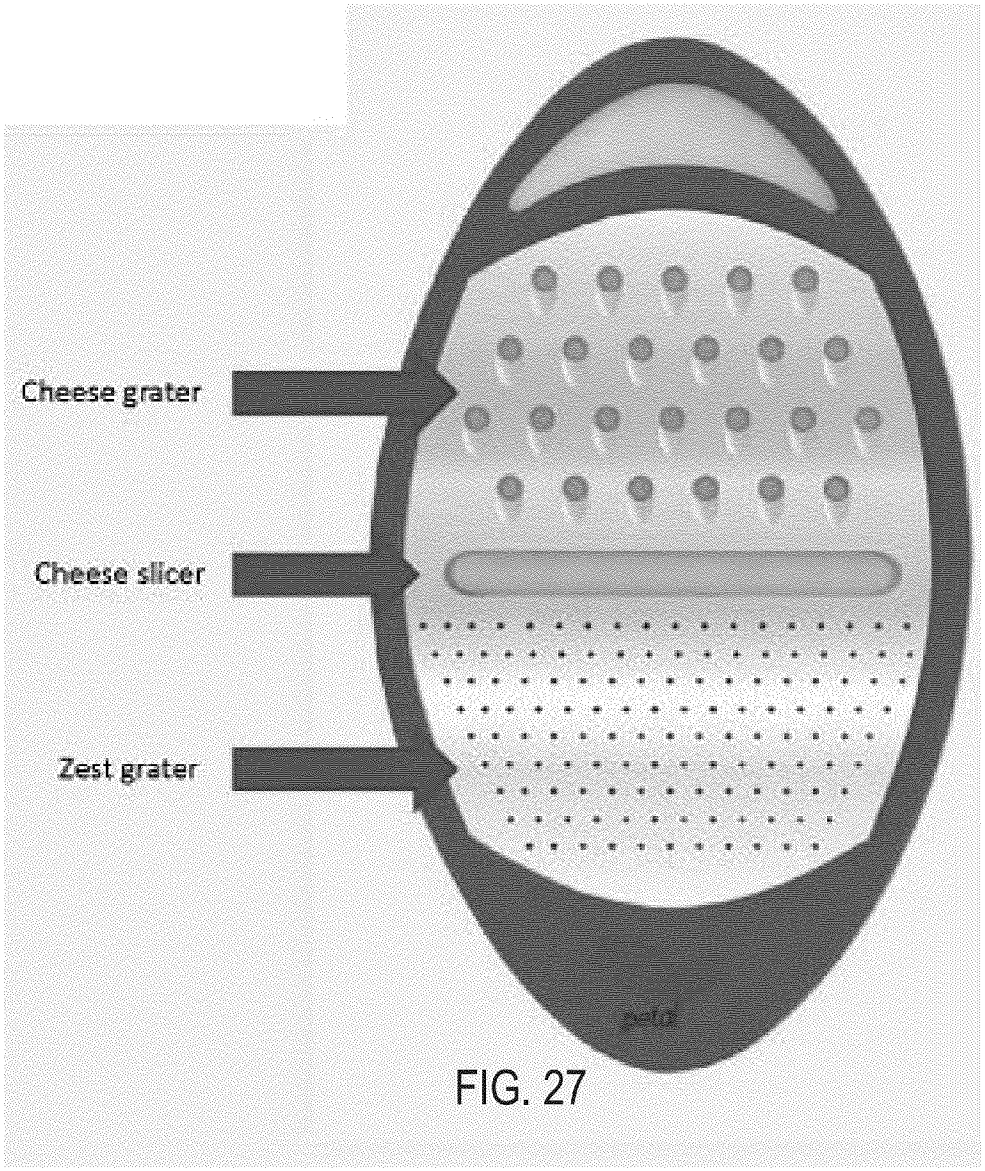
Figure 28:
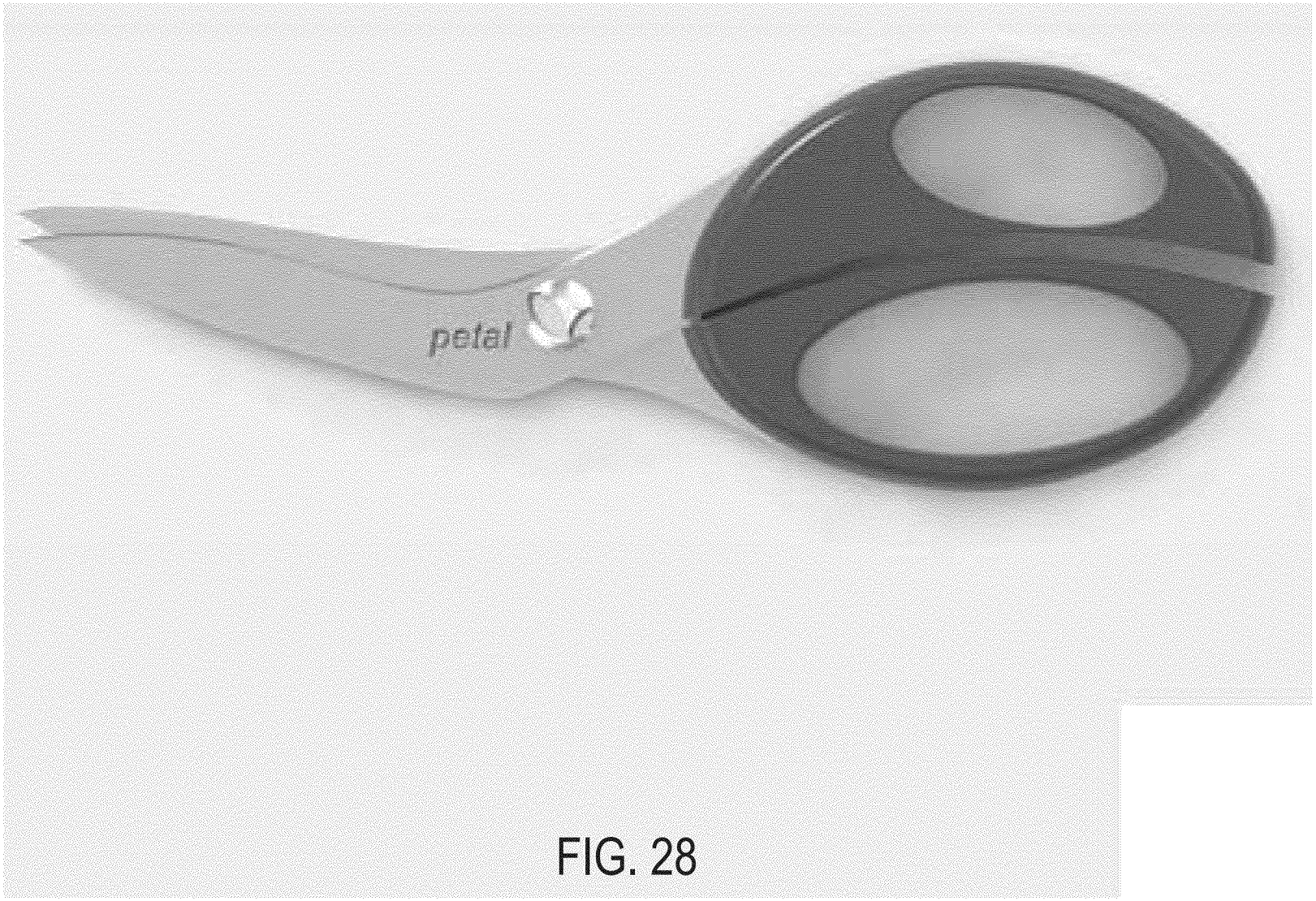
Figure 29:
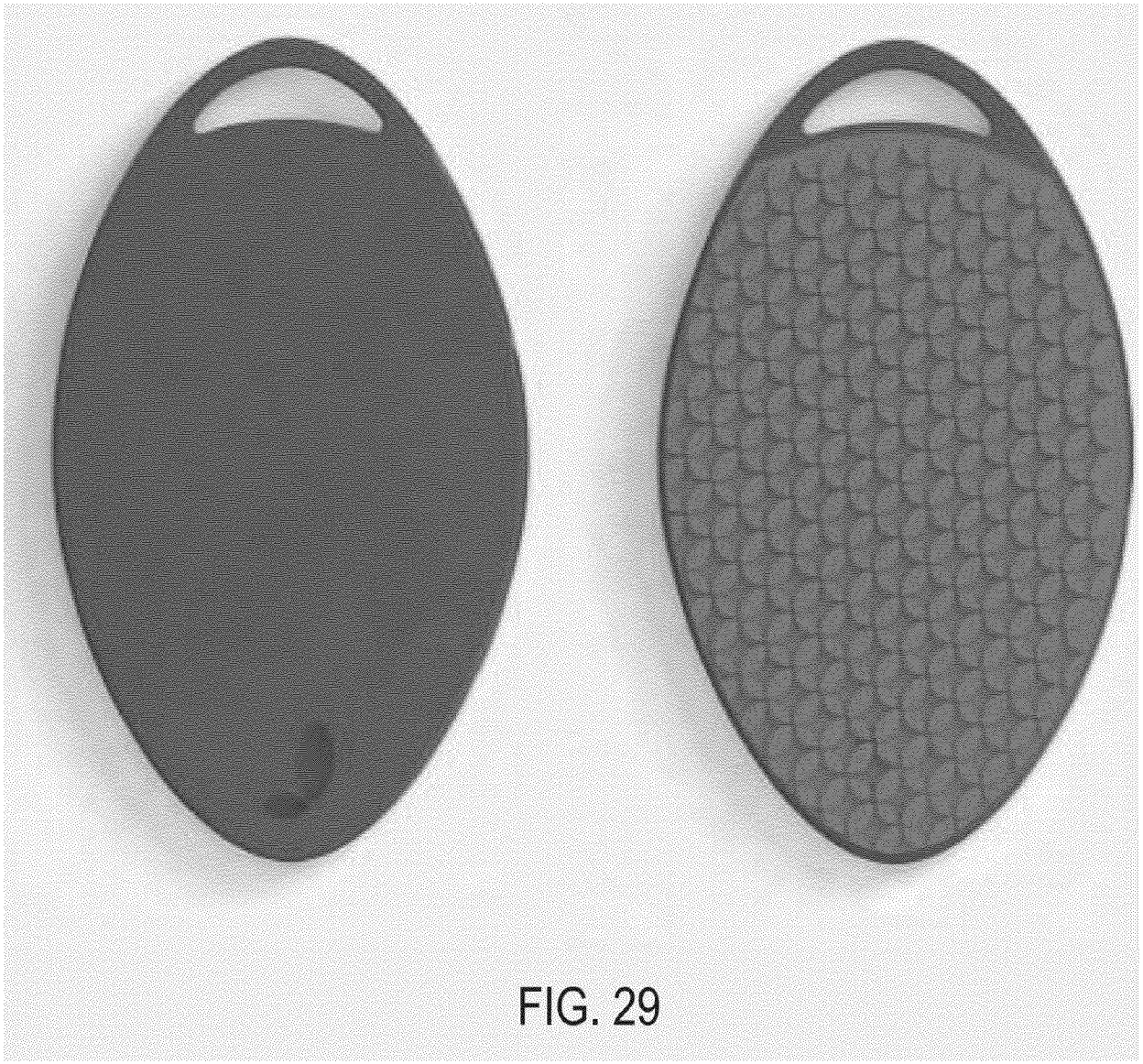
Figure 30:
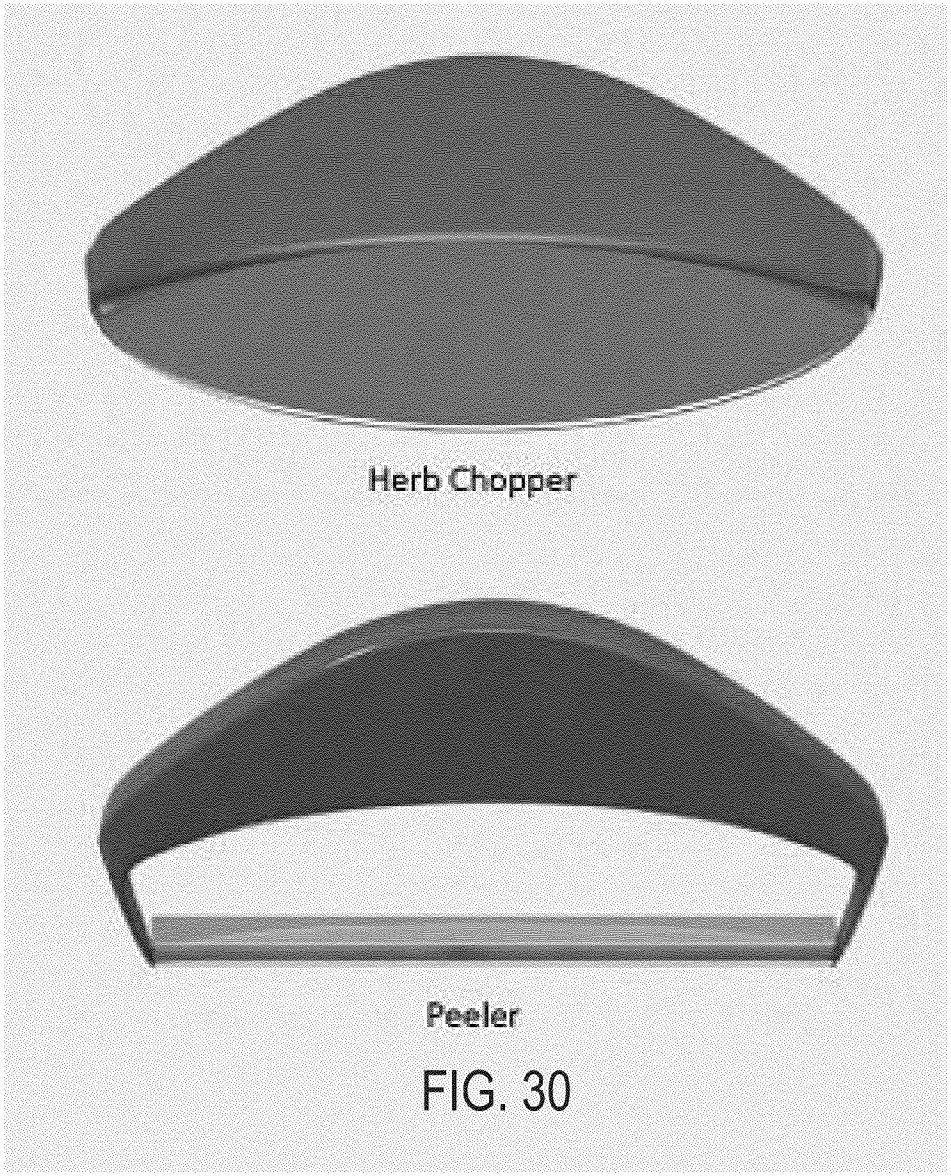
Figure 31:
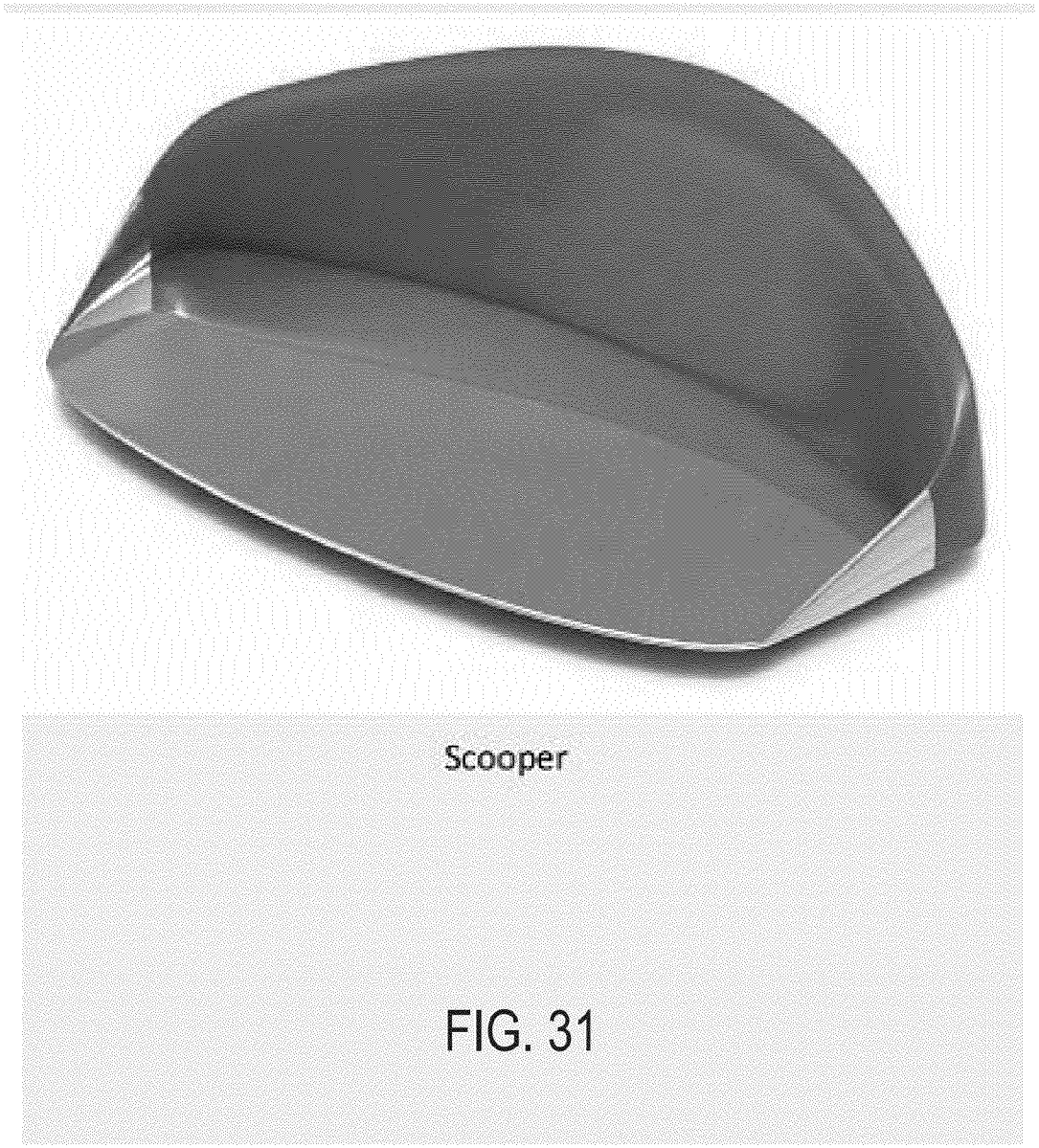
Figure 32:
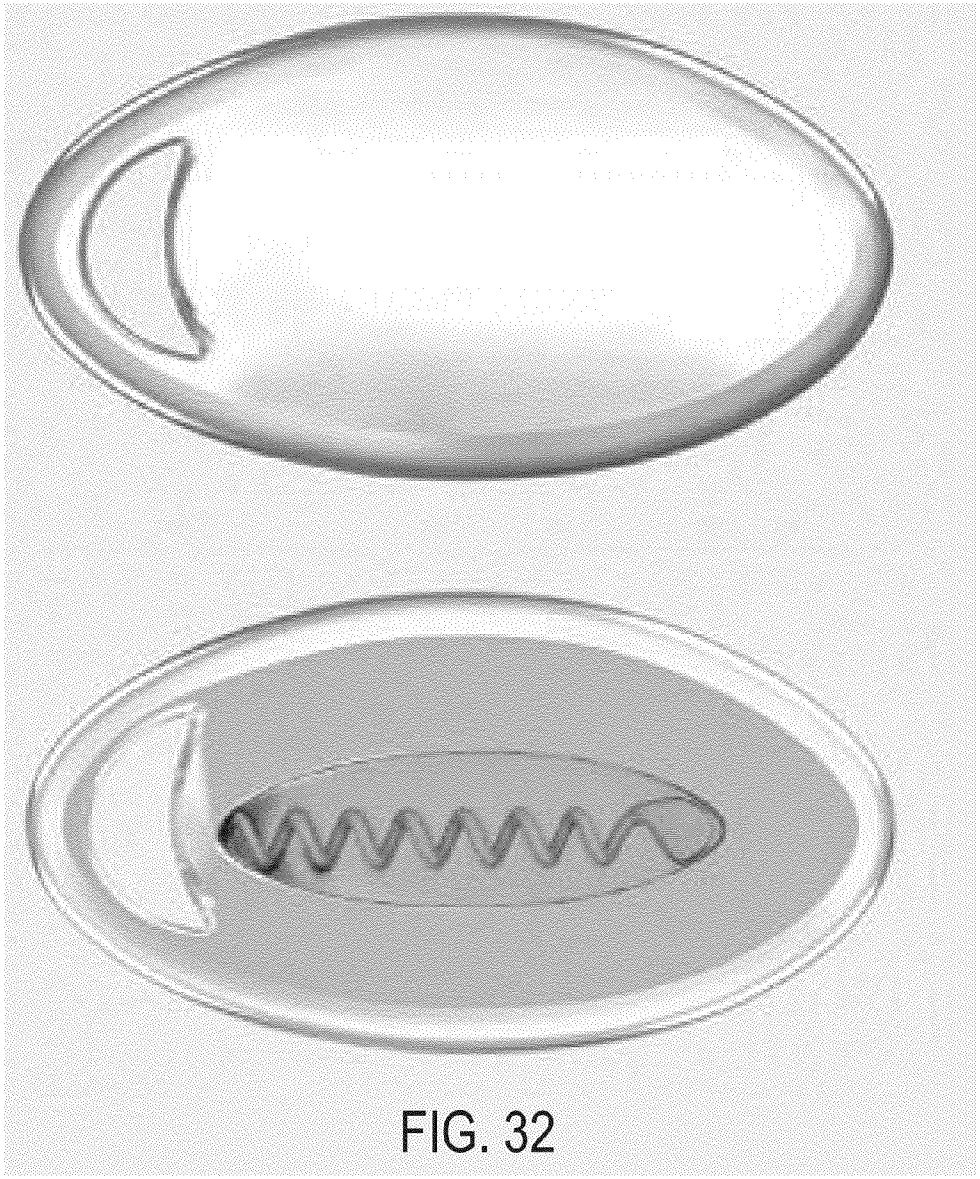
Figure 33:
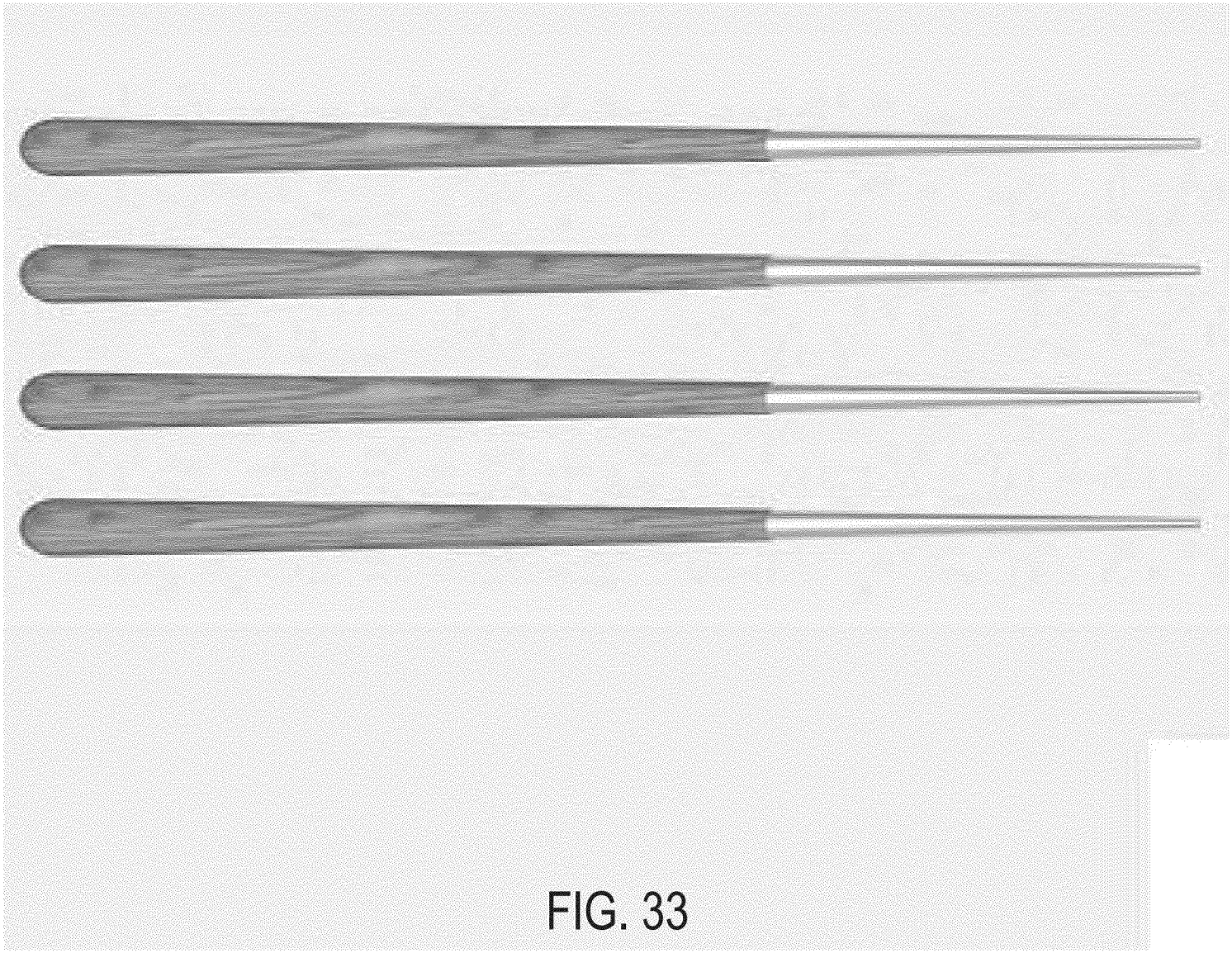

FIGS. 26 to 33 are illustrations of various accessory items usable in the knife block system described herein. As shown, FIG. 26 depicts example grinders; FIG. 27 an example grater with three levels are grating apertures; FIG. 28 the example kitchen shears with ergonomic design that may be positioned within a utility slot; FIG. 29 the front and rear surfaces of the chopping board with female module element that mimics the logo; FIG. 30 the chopper and peeler accessories first shown in system 200 and which may be stored within the sharpener unit; FIG. 31 an example scooper accessory; FIG. 32 the bottle opener showing the ledge for bottles and pivoting corkscrew for wine bottles, and in FIG. 33 example chopsticks configured for storage in a utility slot.

The knife block systems described above have been briefly described as including smart electronics to wirelessly communicate with electronic devices thereon and/or other remote smart devices such as smart phones, smart ovens and refrigerators. The knife block could therefore be integrated with a smart device so as to render it a "smart knife block system" for example, which may be part of a smart kitchen network. Additionally, the smart knife block may be configured to implement a food management program within the smart kitchen network. By extension, the smart kitchen network in turn may also serve as a proximity network within a larger home network.

Accordingly, the kitchen and by extension, the home or other rooms of a home, may therefore be configured into "proximity" networks that can share data within this smart kitchen and devices. Certain devices such as the smart knife block may be set to standards, such as automatic setup, authentication and access, of networking to form a proximity network within the "home" network. In an example, if users where to look at the total home network, they would see these devices within the smart-kitchen domain, and be able to manage these devices individually or in total. This may assist in helping to classify the domain functions of the smart kitchen and smart devices integrated into the smart knife block and/or a food management system.

A smart device in general may be understood as an electronic device that is cordless (unless being charged), mobile (easily transportable), always connected (via Wi-Fi, 3G, 4G etc.) and is capable of voice and video communication, internet browsing, "geo-location" (for search purposes) and which can operate to some extent autonomously. Example commercially well-known smart devices include the Apple® iPhone® and iPad®, and Samsung® Galaxy® tablet.

A smart device can also refer to a ubiquitous computing device, i.e., a device that exhibits some properties of ubiquitous computing including artificial intelligence. Form factors for ubiquitous computing devices include smart devices configured as tabs, pads and boards. Tabs may be understood as accompanied or wearable centimeter-sized devices, e.g., smart phones and smart cards, whereas pads refer to slightly larger decimeter-sized devices such as tablets, netbooks and laptops. Boards represent meter-sized interactive display devices, e.g., horizontal surface computers and vertical smart boards.

Characteristics of any smart device usable in conjunction with or integrated into the knife block may be designed to (a) support a variety of form factors, (b) support a range of properties pertaining to ubiquitous computing; and (c) be used in any combination of the physical world environment, human-centered environments, and distributed computing environments.

If the above characteristics are relaxed to additionally provide information appliances, a much more diverse and potentially more useful range of forms for ubiquitous computing devices/smart devices may be possible, including but not limited to: (1) Dust: miniaturized smart devices without direct HCI interfaces, e.g., Micro Electro-Mechanical Systems (MEMS), ranging from nanometers through micrometers to millimeters; (2) Skin: fabrics based upon light emitting and conductive polymers and organic computer devices. These can be formed into more flexible non-planar display surfaces and products such as clothes and curtains, see OLED display. MEMS devices can also be painted onto various surfaces so that a variety of physical world structures can act as networked surfaces of MEMS; and (3) Clay: ensembles of MEMS can be formed into arbitrary three dimensional shapes, as artifacts resembling different kinds of physical objects.

Accordingly, and in one example only, the block unit in any of the previous embodiments may be outfitted with the characteristics and functional specifications of a smart device/ubiquitous computing device noted above, so as to provide a smart knife block system. The block unit may include smart electronics, a display and contain a number of inputs and output forms, such as usb, miniusb, HDMI, mini-hdmi, etc., so as to mimic or replicate the "tablet" style specifications of for example, a current iPad® version or SAMSUNG® GALAXY TAB® found at http://www.samsung.com/global/microsite/galaxytab/10.1/spec.html. Selected example specifications for the smart device from this link are presented in TABLE 1 below:

TABLE 1

| EXAMPLE SPECS - SMART DEVICE FOR KNIFE BLOCK | |
|---|---|
| Operating System | Honeycomb (Android ®), multitasking & split-view support |
| Processor | 1 GHz dual core NVIDIA ® Tegra ™ 2 processor |
| Memory | 1 GB RAM, 16/32/64 GB (ROM) |
| Cellular/ Wireless | HSPA +21 850/900/1900/2100<br>EDGE/GPRS 850/900/1800/1900<br>Wi-Fi 802.11 a/b/g/h dual-band support (2.4 Ghz, 5 Ghz)<br>Bluetooth 3.0<br>Wi-Fi direct |
| Display | 10.1" widescreen<br>1280 × 800 WXGA TFT LCD<br>149 ppi (pixels per inch)<br>4-way rotation<br>Live panel (Samsung ® Touchwiz ™ UX) |
| Browser | Android ® browser, Adobe ® Flash ™ support |
| Input/Output | 30-pin dock connector port, 3.5 mm stereo headphone jack |
| Sensors | gyroscope, accelerometer, ambient light sensor, compass |
| Location | A-GPS, Google Maps ™ |
| Video | Full HD video playback (1080 p) @ 30 fps<br>Video codec: WMV9, WMV7, WMV8, H.264, MPEG4, DivX, H.263, VP8 |
| Audio | Formats: MP3, AAC, AAC+, eAAC+, WMA, RA<br>Surround sound speakers |

TABLE 1-continued

| EXAMPLE SPECS - SMART DEVICE FOR KNIFE BLOCK | |
|---|---|
| Battery | 7000 mAh built-in Li+, Video: up to 9 hrs; Music: up to 72 hrs |

Accordingly, the block unit could include a tablet style electronic display having functions similar to conventional tablets, and/or being configured as a screen or application based device, such as a touch screen and multi-use display, so there is flexibility of function and the ability to customize and program the device to meet the needs of the users. An internal speaker may reside within this section as well to stream music or give auditory alerts and messages.

The smart knife block may provide a vehicle to help users cook and display and/or offer auditory recipes and cooking tips. The scale could be integrated wirelessly into the recipe management system, so it can confirm that the proper amount of items is used by weight during the process of cooking instruction. This is similar to the smart ovens being able to communicate to the recipe manager so as to know the proper settings such as preheating, cooking and timing, and in turn communicate to the tablet display on the block unit or devices during the process of cooking.

The smart knife block could assist in cooking and recipe management by using data communicated from a smart refrigerator or other food stores, where RFID tags, scanned or wirelessly compiled and analyzed, creates suggestions for food to be prepared from available food and ingredient stores. Time frame, calories, special food diets, and other data could be taken into consideration in a profile based management system that will meet the needs and desires of users, in and individual sense or a group and family setting. Math and logic may be used to analyze the data. This data could tie into a food and ingredient ordering system where the order can be automatically sent to the store/provider and process the sale. Automatic shipping and delivery systems could be in place or semi-automated customer pickup could be provided.

The smart knife block described above could be link to the internet with a traditional website with separate user interface and login so other smart devices could manage, interact and display and use the system. It could be accessed with remote tablets, smart phone, internet TV or other compatible internet devices.

Power to the smart knife block may be via batteries, rechargeable or not (replaceable or fixed) to power the totality of these devices from a single power source. The system may be powered via AC wall power by cord. Alternatively, each system may contain its own battery/power source, capable of being charged from a central base station. Individual systems could be powered and charged electro conductively so when removed are able to be used as separate devices with onboard battery stores.

An example of using RFID tags with the smart knife block system and using an NFC/RFID reader is described below. This is described in a general context of acquiring data to link to a recipe, food and health management data and analysis system. The smart knife block system can use RFID technology to be aware of what food products are put inside a refrigerator, i.e. tagging food. Radio Frequency Identification (RFID) is a technology that uses communication through the use of radio waves to exchange data between a reader and an electronic tag attached to an object, for the purpose of identification and tracking. Radio Frequency Identification is an automatic identification method, relying on storing and remotely retrieving data using devices called RFID tags or transponders. An RFID tag is an object that can be attached to or incorporated into a product, animal, or person for the purpose of identification using radio waves. RFID makes it possible to give each product its own unique identifying number, to provide detailed information for the product such as production date, expiration date, etc.

Figure 34:
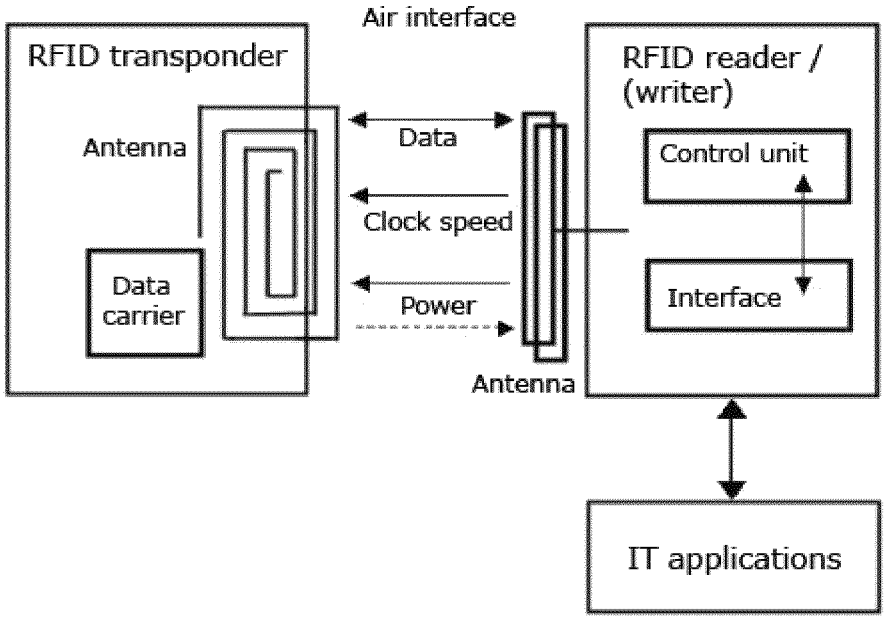
FIG. 34 is a block diagram to show the relationship between an RFID tag and an RFID reader.

FIG. 34 is a block diagram to show the relationship between an RFID tag and an RFID reader. RFID is composed of tags, readers, antenna and middleware and application software. When label enters the magnetic field, it will receive the RF signal emitted by reader and send out the product information that is stored in the chip by the energy obtained by the induced current, or take the initiative to send a signal of some certain frequency. Readers will send the information to the central information system for processing after it reads and decodes the information.

The smart knife block system tablet electronics may include a device for a food management system. The working principle of the device is similar to the RFID read which can read the RFID tags on food and enable users to understand the situation in a refrigerator. As we mentioned above, the RFID tag on food include the expiration dates and other related information of the food. Hence, we can use the tablet screen to display the food management and get the detailed information about the food. Alternatively, the refrigerator, if a smart refrigerator, may have an LCD screen that enables the knife block in proximity to capture detailed information about the food from the LCD screen, with the smart knife block system communicating with the refrigerator LCD screen.

There will be certain items that may not have tags that the user will have to enter manually. For example, a user picks up a bag of apples from the farmer's market. The user selects a scan tab within the food management application on the tablet screen and does an incremental search to find the item they want to enter. Also there will be an option for quantity. The other option is just to go to a fruit and vegetable tab where there will be pictures of fruits and vegetables sort alphabetically and select the image of the apple.

In an example, a database in the smart knife block system memory contains different recipes within the food management application based on different regions in the world, user entries, etc. Therefore based on the contents in the user's refrigerator, the smart knife block system will be able to make recipe suggestions. Users can select the kind of recipes that they want on the tablet screen to look at the recipes.

Based on the RFID technology, the smart knife block will be able to know what the user has in their refrigerator via the RFID tags on the items and continuously update the information such as the amounts or weights in the database. The smart knife block system will be aware that the amounts or weights of certain items decrease or increase. Therefore when the user goes shopping, they can open the food management application and press the shopping list button. The smart knife block system will present a shopping list for you.

A stock tab within the food management application can be implemented to inform a user to see what is inside their refrigerator with looking inside. The interface will be similar to the scan interface. The user can browse what is inside the refrigerator based on the categories or the incremental search. Only items that are actually in the refrigerator will be returned from the search or displayed the various categories. There will be also an indicator will the product is about to expire or is expired.

The example embodiments being thus described, it will be obvious that the same may be varied in many ways. Such variations are not to be regarded as departure from the example embodiments, and all such modifications as would be obvious to one skilled in the art are intended to be included in the following claims.

We claim:

1. A knife block system, comprising:

a block unit having a plurality of slots on one surface thereof, a plurality of knives positioned within the slots, a foot supporting the block unit, a glass cover overlay positioned on the block unit, the cover including indicia labeling the knives and providing a clear display of the knives there behind, at least one chopping board protruding from a surface of the block unit and removable from the block unit for use, the at least one chopping board configured to fit into a chopping board back support positioned opposite the knives on a surface of the block unit for storage when not in use, the at least one chopping board having a female module formed therein, and a knife sharpener unit removably attachable to the foot for use, the knife sharpener unit having a male connector on a surface thereof that mates with the female module on the at least one chopping board to secure the knife sharpener unit to the at least one chopping board as both items are in use.

2. The system of claim 1, wherein the knife sharpener unit further includes recesses for storing a peeler, a chopper, and a plurality of concentric measuring cups therein.

3. The system of claim 1, wherein each of the plurality of knives includes alternating-angle scalloping Santoku shape forms on the knife blade sides that mimics a petal-shaped logo on the block unit, the alternating angles of the scallops permitting more air release and less sticking of food on the knife blade.

4. A knife block system, comprising:

a block unit having a magnetic core, a plurality of knives secured to the magnetic core of the block unit, a foot supporting the block unit, at least one chopping board protruding from a surface of the block unit and removable from the block unit for use, the at least one chopping board configured to fit into a chopping board back support positioned opposite the knives on a surface of the block unit for storage when not in use, the at least one chopping board having a female module formed therein, and a knife sharpener unit removably attachable to the foot for use, the knife sharpener unit having a product logo on a surface thereof that is sized to mate with the female module on the at least one chopping board to secure the knife sharpener unit to the at least one chopping board as both items are in use.

5. The system of claim 4, wherein the chopping board back support further includes a shape form element for attaching an additional accessory thereto.

6. The system of claim 4, further comprising:

a removable clock/timer provided on the block unit.

7. The system of claim 4, further comprising:

a removable bottle opener accessory provided on the block unit.

8. The system of claim 4, wherein the knife sharpener unit further includes a recipe holder.

9. The system of claim 4, wherein the knife sharpener unit further includes recesses for storing a peeler, a chopper, and a plurality of concentric measuring cups therein.

10. The system of claim 4, wherein each of the plurality of knives includes alternating-angle scalloping Santoku shape forms on the knife blade sides that mimics a petal-shaped product logo on the knife sharpener unit, the alternating angles of the scallops permitting more air release and less sticking of food on the knife blade.

11. A knife block system, comprising:

a block unit having a magnetic core, a plurality of knives secured to the magnetic core of the block unit, a foot supporting the block unit, at least one chopping board protruding from a surface of the block unit and removable from the block unit for use, the at least one chopping board configured to fit into a chopping board back support positioned opposite the knives on a surface of the block unit for storage when not in use, the at least one chopping board having a female module formed therein, a removable clock/timer provided on the block unit, and a digital scale removably attachable to the foot for use, the digital scale having a product logo on a surface thereof that is sized to mate with the female module on the at least one chopping board to secure the digital scale to the at least one chopping board as both items are in use.

* * * * *